US011318581B2

(12) United States Patent
Craigen et al.

(10) Patent No.: US 11,318,581 B2
(45) Date of Patent: May 3, 2022

(54) ABRASIVE FLUID JET CUTTING SYSTEMS, COMPONENTS AND RELATED METHODS FOR CUTTING SENSITIVE MATERIALS

(71) Applicant: Flow International Corporation, Kent, WA (US)

(72) Inventors: Steven J. Craigen, Auburn, WA (US); Mohamed A. Hashish, Bellevue, WA (US)

(73) Assignee: Flow International Corporation, Kent, WA (US)

( * ) Notice: Subject to any disclaimer, the term of this patent is extended or adjusted under 35 U.S.C. 154(b) by 560 days.

(21) Appl. No.: 15/990,375

(22) Filed: May 25, 2018

(65) Prior Publication Data

US 2019/0358775 A1 Nov. 28, 2019

(51) Int. Cl.

| | |
|---|---|
| ***B24C 7/00*** | (2006.01) |
| ***B24C 1/04*** | (2006.01) |
| ***B24C 3/22*** | (2006.01) |
| ***B24C 5/04*** | (2006.01) |
| *B26F 3/00* | (2006.01) |

(52) U.S. Cl.

CPC ..... *B24C 7/0076* (2013.01); *B24C 1/045* (2013.01); *B24C 3/22* (2013.01); *B24C 7/003* (2013.01); *B24C 5/04* (2013.01); *B24C 7/0084* (2013.01); *B26F 3/004* (2013.01)

(58) Field of Classification Search

CPC .. B24C 1/045; B24C 3/22; B24C 3/12; B24C 5/02; B24C 5/04; B24C 7/0007; B24C 7/003; B24C 7/0046; B24C 7/0069; B24C 7/0076; B24C 7/0084; B24C 7/0092; B26F 3/004; B26F 3/008; B26F 1/26; B24B 57/02; B26D 2/10; B26D 2/14; B26D 7/20

USPC ..... 451/28, 38, 40, 75, 87, 89, 90, 102; 83/53, 177

See application file for complete search history.

(56) References Cited

U.S. PATENT DOCUMENTS

| | | | |
|---|---|---|---|
| 4,648,215 | A | 3/1987 | Hashish et al. |
| 4,832,266 | A | 5/1989 | Marvin |

(Continued)

FOREIGN PATENT DOCUMENTS

| | | | |
|---|---|---|---|
| EP | 0391500 | A2 | 10/1990 |
| EP | 2 512 738 | B1 | 3/2016 |

OTHER PUBLICATIONS

International Search Report and Written Opinion of the International Searching Authority dated Aug. 22, 2019, issued in corresponding International Application No. PCT/US2019/032057, filed May 13, 2019, 25 pages.

(Continued)

*Primary Examiner* — Tyrone V Hall, Jr.
*Assistant Examiner* — Makena S Markman
(74) *Attorney, Agent, or Firm* — Cozen O'Connor

(57) ABSTRACT

Fluid jet cutting systems, components and related methods for generating relatively low load abrasive fluid jets that are particularly well suited for cutting fragile, brittle or otherwise sensitive materials are provided. An example method includes supplying fluid at an operating pressure of at least 60,000 psi to an orifice having a circular cross-sectional profile with a diameter that is less than or equal to 0.010 inches to create a fluid jet that leaves a fluid jet cutting head through a jet passageway having a circular cross-sectional profile with a diameter that is less than or equal to 0.015 inches.

21 Claims, 6 Drawing Sheets

(56) References Cited

U.S. PATENT DOCUMENTS

| | | | | |
|---|---|---|---|---|
| 4,836,455 | A * | 6/1989 | Munoz | B05B 7/149 239/590.3 |
| 4,951,429 | A | 8/1990 | Hashish et al. | |
| 5,643,058 | A | 7/1997 | Erichsen et al. | |
| 5,704,824 | A | 1/1998 | Hashish et al. | |
| 5,782,673 | A | 7/1998 | Warehime | |
| 6,077,152 | A | 6/2000 | Warehime | |
| 6,752,685 | B2 * | 6/2004 | Ulrich | B24C 1/045 451/102 |
| 6,766,216 | B2 | 7/2004 | Erichsen et al. | |
| 6,932,285 | B1 | 8/2005 | Zeng | |
| 7,862,405 | B2 | 1/2011 | Hashish | |
| 7,934,977 | B2 * | 5/2011 | Hashish | B24C 1/045 451/36 |
| 8,448,880 | B2 | 5/2013 | Hashish et al. | |
| 8,783,146 | B2 | 7/2014 | Chacko et al. | |
| 9,003,936 | B2 | 4/2015 | Chillman et al. | |
| 9,156,133 | B2 | 10/2015 | Miller | |
| 9,440,370 | B2 | 9/2016 | Hayden | |
| 2005/0017091 | A1 * | 1/2005 | Olsen | B24C 5/02 239/400 |
| 2005/0233682 | A1 * | 10/2005 | Chisum | B24C 1/045 451/102 |
| 2008/0220699 | A1 | 9/2008 | Hashish | |
| 2009/0071303 | A1 | 3/2009 | Hashish et al. | |
| 2009/0318064 | A1 | 12/2009 | Hashish | |
| 2010/0267314 | A1 | 10/2010 | Cvjeticanin et al. | |
| 2015/0031270 | A1 | 1/2015 | Miller | |
| 2015/0093969 | A1 * | 4/2015 | Mase | B24C 9/006 451/38 |
| 2015/0196989 | A1 * | 7/2015 | Hashish | B26F 3/004 451/40 |

OTHER PUBLICATIONS

OMAX Corporation, "OMAX Intelli-MAX: From File to Finished Part," Software Overview, May 2017, 2 pages.

OMAX Corporation, "OMAX Maxjet 5i Nozzle," Accessory Specification, Jan. 2012, 2 pages.

OMAX Corporation, "OMAX MicroMAX JetMachining Center," Specification Sheet, Jul. 2017, 2 pages.

Waurzyniak, "Scaling Down Waterjets to the Micro Level," ManufacturingEngineeringMedia.com, Nov. 2013, pp. 59-66. (7 pages).

Extended European Search Report, dated Dec. 10, 2021, for corresponding European Application No. 19807384.3, 11 pages.

* cited by examiner

ABRASIVE FLUID JET CUTTING SYSTEMS, COMPONENTS AND RELATED METHODS FOR CUTTING SENSITIVE MATERIALS

BACKGROUND

Technical Field

This disclosure is related to fluid jet cutting systems and related methods, and, more particularly, to abrasive waterjet systems, components and related methods that facilitate cutting of brittle, fragile, or otherwise sensitive materials with a low load abrasive waterjet.

Description of the Related Art

Waterjet or abrasive waterjet cutting systems are used for cutting a wide variety of materials, including stone, glass, ceramics and metals. In a typical waterjet cutting system, high-pressure water flows through a cutting head having a nozzle which directs a cutting jet onto a workpiece. The system may draw or feed abrasive media into the high-pressure waterjet to form a high-pressure abrasive waterjet. The cutting head may then be controllably moved across the workpiece to cut the workpiece as desired, or the workpiece may be controllably moved beneath the waterjet or abrasive waterjet. Systems for generating high-pressure waterjets are currently available, such as, for example, the Mach 4™ five-axis waterjet cutting system manufactured by Flow International Corporation, the assignee of the present application. Other examples of waterjet cutting systems are shown and described in Flow's U.S. Pat. No. 5,643,058.

Abrasive waterjet cutting systems are advantageously used when cutting workpieces made of particularly hard materials to meet exacting standards; however, the use of abrasives introduces complexities, and abrasive waterjet cutting systems can suffer from other drawbacks, including the need to contain and manage spent abrasives. Known abrasive waterjet cutting systems may not be particularly well suited for cutting or machining some types of fragile or brittle materials, such as printed circuit boards (which can include several laminated layers of metal and/or plastic).

Known options for cutting fragile or brittle materials, such as printed circuit boards or glass, include machining (e.g., drilling, routing) such materials with carbide and diamond-coated carbide cutting tools (e.g., drill bits, routers). Machining forces from such cutting tools, however, can promote workpiece failures such as delamination, chipping, fracturing, etc. These types of cutting tools can also be susceptible to premature wear, and must be replaced frequently to ensure an acceptable finish, thereby increasing operational costs. Moreover, machining with cutting tools generates dust that can create environmental hazards and negatively impact machining performance.

Thus, applicant believes improved systems and methods for cutting brittle, fragile, or otherwise sensitive materials are desirable.

BRIEF SUMMARY

Embodiments of the fluid jet cutting systems, components and related methods disclosed herein are particularly well suited for cutting or machining brittle, fragile, or otherwise sensitive materials to exacting standards.

As one example, a fluid jet cutting head that is particularly well suited for cutting or machining brittle, fragile, or otherwise sensitive materials to exacting standards may be summarized as including: a nozzle body; an orifice mount received within the nozzle body, the orifice mount including an orifice unit having an orifice for generating a fluid jet during operation, the orifice having a circular cross-sectional profile with a diameter that is less than or equal to 0.010 inches; a fluid delivery body having a fluid delivery conduit to supply a flow of high pressure fluid to the orifice of the orifice mount to generate the fluid jet during operation; a mixing chamber provided downstream of the orifice mount in a path of the fluid jet, the mixing chamber being configured to receive abrasives to be mixed with the fluid jet generated by the orifice of the orifice mount to form an abrasive fluid jet; and; a nozzle having a jet passageway from which to discharge the abrasive fluid jet from the fluid jet cutting head during operation, the jet passageway having a circular cross-sectional profile with a diameter that is less than or equal to 0.015 inches. In some instances, the diameter of the orifice may be less than or equal to 0.005 inches, less than or equal to 0.003 inches, less than or equal to 0.002 inches, or less than or equal to 0.001 inches. In some instances, the diameter of the jet passageway may be less than or equal to 0.010 inches, less than or equal to 0.008 inches, or less than or equal to 0.006 inches. In some instances, the diameter of the orifice may be less than or equal to 0.005 inches and the diameter of the jet passageway may be less than or equal to 0.010 inches, the diameter of the orifice may be less than or equal to 0.003 inches and the diameter of the jet passageway may be less than or equal to 0.008 inches, or the diameter of the orifice may be less than or equal to 0.002 inches and the diameter of the jet passageway may be less than or equal to 0.006 inches. In some instances, a ratio of the diameter of the jet passageway to the diameter of the orifice of the orifice mount may be less than or equal to 3.0 and greater than or equal to 1.5. In some instances, the orifice of the orifice mount and the jet passageway of the nozzle may be axially aligned with less than 0.001 inches of offset misalignment.

The fluid jet cutting head may further comprise a plurality of orifice mount adjusters configured to adjust a position of the orifice mount in a plane transverse to an axis defined by the orifice to align the fluid jet generated at the orifice with the jet passageway of the nozzle.

The fluid jet cutting head may further comprise a mixing chamber insert. The mixing chamber insert may include the mixing chamber through which the fluid jet passes during operation, an abrasives inlet conduit through which abrasives flow to the mixing chamber during operation, and an abrasives outlet conduit through which abrasives flow from the mixing chamber during operation. A location of an intersection of the abrasives inlet conduit with the mixing chamber may be vertically offset from a location of an intersection of the abrasives outlet conduit with the mixing chamber. The mixing chamber insert may include an abrasives inlet port at the location of the intersection of the abrasives inlet conduit with the mixing chamber and an abrasives outlet port at the intersection of the abrasives outlet conduit with the mixing chamber, and the abrasives outlet port may be located closer to a jet inlet of the mixing chamber insert than the abrasives inlet port such that the abrasives outlet port is upstream of the abrasives inlet port with respect to a flow path of the fluid jet through the mixing chamber insert during operation.

The nozzle body may comprise: an abrasives entry passageway extending from an exterior of the nozzle body to the mixing chamber for supplying abrasives to be mixed with the fluid jet generated at the orifice during operation, the abrasives entry passageway defining an abrasives entry direction; and an abrasives exit passageway extending from the exterior of the nozzle body to the mixing chamber for withdrawing abrasives that are not mixed with the fluid jet, the abrasives exit passageway defining an abrasives exit direction, and wherein a spread angle defined by the abrasives entry direction and the abrasives exit direction projected onto a reference plane that is perpendicular to an axis defined by the fluid jet is between 30 degrees and 150 degrees.

A fluid jet cutting system may include the fluid jet cutting head and a source of abrasive material coupled to the abrasives entry passageway of the nozzle body for supplying the abrasives to be mixed with the fluid jet. The fluid jet cutting system may further include a vacuum source coupled to the abrasives exit passageway of the nozzle body to assist in drawing abrasives into the mixing chamber and for withdrawing the abrasives that are not mixed with the fluid jet. The fluid jet cutting system may further include an abrasives feed line coupling the source of abrasive material to the nozzle body and having an abrasives entry passageway for supplying abrasives to the mixing chamber insert. The fluid jet cutting system may further include an abrasives suction line coupling the vacuum source to the nozzle body and having an abrasives exit passageway for assisting in drawing abrasives into the mixing chamber insert and withdrawing abrasives that are not mixed with the fluid jet out of the mixing chamber insert during operation. A cross-sectional area of the abrasives entry passageway of the abrasives feed line may be smaller (e.g., at least 10% smaller) than a cross-sectional area of the exit passageway of the suction line.

A fluid jet cutting system may include the fluid jet cutting head and a high pressure pump in fluid communication with the fluid jet cutting head and operable to supply the high pressure fluid to the orifice at an operating pressure of at least 60,000 psi, at least 70,000 psi, at least 80,000 psi, at least 90,000 psi, at least 100,000 psi, or at least 110,000 psi.

According to one embodiment, a method of operating a fluid jet cutting system may be summarized as including: supplying a flow of fluid at an operating pressure of at least 60,000 psi to an orifice of an orifice unit of an orifice mount provided within a cutting head of the fluid jet system to generate a fluid jet that passes through a mixing chamber prior to a jet passageway of a nozzle located downstream of the mixing chamber, the orifice having a circular cross-sectional profile with a diameter that is less than or equal to 0.010 inches, the jet passageway having a circular cross-sectional profile with a diameter that is less than or equal to 0.015 inches; mixing abrasives with the fluid jet within the mixing chamber to form an abrasive fluid jet to be discharged from the cutting head via the jet passageway of the nozzle; and discharging the abrasive fluid jet from the cutting head to process a workpiece or work surface.

The method may further include, prior to supplying the flow of fluid, adjusting an alignment of the orifice of the orifice mount relative to the jet passageway of the nozzle such that the orifice and the jet passageway are axially aligned with less than 0.001 inches of offset misalignment.

Mixing abrasives with the fluid jet may include mixing abrasive particles having a maximum particle dimension of one third of a diameter of the jet passageway with the fluid jet. Mixing abrasives with the fluid jet may include supplying the abrasive particles to the mixing chamber continuously throughout the discharging of the abrasive fluid jet. Discharging the abrasive fluid jet from the cutting head to process the workpiece or work surface may include intermittently discharging the abrasive fluid jet from the cutting head, and the method may further include: continuously feeding abrasives to the mixing chamber without interruption throughout the intermittent discharging of the abrasive fluid jet. Mixing abrasives with the fluid jet may include supplying the abrasive particles to the mixing chamber continuously throughout the discharging of the abrasive fluid jet and at a rate of about or less than or equal to 0.5 pounds per minute.

Supplying the flow of fluid to the orifice of the orifice mount may include supplying the flow of fluid at an operating pressure of at least 60,000 psi, at least 70,000 psi, at least 80,000 psi, at least 90,000 psi, at least 100,000 psi, or at least 110,000 psi.

The method may further include: supplying a flow of fluid at an alignment pressure level through the orifice of the orifice mount to generate a low pressure fluid jet; observing an alignment of the low pressure fluid jet with the jet passageway; and adjusting a position of the orifice mount based on a result of the observing until the orifice is aligned with the jet passageway.

Mixing abrasives with the fluid jet within the mixing chamber may include introducing abrasives into the mixing chamber at a first location and removing abrasives from the mixing chamber at a second location that is upstream, with respect to a flow path of the fluid jet through the mixing chamber during operation, of the first location.

According to another embodiment, a fluid jet cutting head may be summarized as including: a nozzle body having an orifice mount receiving cavity; an orifice mount received within the orifice mount receiving cavity of the nozzle body, the orifice mount comprising an orifice unit having an orifice for generating a fluid jet during operation; a fluid delivery body having a fluid delivery conduit to supply a flow of fluid through the orifice of the orifice mount to generate the fluid jet during operation; a nozzle having a jet passageway from which to discharge the fluid jet from the fluid jet cutting head; and a plurality of orifice mount adjusters configured to adjust a position of the orifice mount in a plane transverse to an axis defined by the orifice to align the fluid jet generated at the orifice with the jet passageway of the nozzle.

The plurality of orifice mount adjusters may comprise a plurality of set screws that are coupled to the nozzle body and operable to displace the orifice mount in the plane that is transverse to the axis of the orifice. The orifice mount adjusters may further comprise a plurality of locating pins that can be axially displaced by the plurality of set screws to engage and displace the orifice mount.

The fluid jet cutting system may further comprise: a mixing chamber insert, the mixing chamber insert including a mixing chamber through which the fluid jet passes during operation, an abrasives inlet conduit through which abrasives flow to the mixing chamber during operation, and an abrasives outlet conduit through which abrasives flow from the mixing chamber during operation. The mixing chamber insert may further include an abrasives inlet port that couples the abrasives inlet conduit to the mixing chamber and an abrasives outlet port that couples the abrasives outlet conduit to the mixing chamber, the abrasives outlet port located upstream, with respect to a flow path of the fluid jet through the mixing chamber during operation, of the abrasives inlet port.

A method of operating a fluid jet cutting head, according to one example embodiment, may be summarized as including: positioning an orifice mount within a nozzle body of the fluid jet cutting head, the orifice mount comprising an orifice unit having an orifice for generating a fluid jet during operation; supplying a flow of fluid at an alignment pressure level through the orifice of the orifice mount to generate a low pressure fluid jet; observing an alignment of the low pressure fluid jet with a jet passageway of a nozzle of the fluid jet cutting head; and adjusting a position of the orifice mount based on a result of the observing until the orifice is aligned with the jet passageway of the nozzle.

The method may further include: after adjusting the position of the orifice mount, supplying a flow of fluid at an operating pressure to the orifice of the orifice mount, the operating pressure being higher than the alignment pressure level to generate a high pressure fluid jet for processing a workpiece or work surface. The method may further include: prior to supplying the flow of fluid at the alignment pressure level through the orifice of the orifice mount, urging the orifice mount into sealing engagement with a fluid delivery body having a fluid delivery conduit for supplying fluid to the orifice mount. Urging the orifice mount into sealing engagement with the fluid delivery body may include compressing a seal member to a first degree, and the method may further include: prior to supplying a flow of fluid at an operating pressure through the orifice of the orifice mount to generate a high pressure fluid jet for processing a workpiece or work surface, further urging the orifice mount into sealing engagement with the fluid delivery body to compress the seal member to a second degree that is higher than the first degree.

Adjusting the position of the orifice mount may include adjusting at least one of a plurality of set screws that are coupled to the nozzle body and operable to displace the orifice mount in a plane that is transverse to an axis of the orifice. Adjusting at least one of the plurality of set screws may include advancing at least one of the set screws to axially displace one of a plurality of corresponding locating pins to engage and displace the orifice mount.

The method may further comprise: after adjusting the position of the orifice mount, confirming a desired alignment of the orifice mount with the jet passageway of the nozzle of the fluid jet cutting head using the low pressure fluid jet. The method may further comprise: after adjusting the position of the orifice mount and confirming the desired alignment of the orifice mount, fixedly securing the orifice mount in place by manipulating the nozzle body relative to a fluid delivery body which has a fluid delivery conduit for supplying fluid to the orifice mount. Fixedly securing the orifice mount in place may be achieved without applying a torque to the orifice mount as the nozzle body is manipulated relative to the fluid delivery body. Manipulating the nozzle body relative to the fluid delivery body may include torqueing the nozzle body relative to the fluid delivery body. Adjusting the position of the orifice mount until the orifice is aligned with the jet passageway of the nozzle may include moving the orifice mount until the orifice and the jet passageway are axially aligned with less than 0.001 inches of offset misalignment.

According to another embodiment, a nozzle body of a fluid jet cutting head may be summarized as including: an orifice mount receiving cavity sized and shaped to receive an orifice mount having an orifice unit with an orifice for generating a fluid jet during operation when high pressure fluid is passed therethrough; a mixing chamber located adjacent the orifice mount receiving cavity; an abrasives entry passageway extending from an exterior of the nozzle body to the mixing chamber for supplying abrasives to be mixed with the fluid jet generated by the orifice during operation, the abrasives entry passageway defining an abrasives entry direction; and an abrasives exit passageway extending from the exterior of the nozzle body to the mixing chamber for withdrawing abrasives that are not mixed with the fluid jet, the abrasives exit passageway defining an abrasives exit direction, and wherein a spread angle defined by the abrasives entry direction and the abrasives exit direction projected onto a reference plane that is perpendicular to an axis defined by the fluid jet is between 30 degrees and 150 degrees.

In some instances, the spread angle may be between 45 degrees and 135 degrees, between 60 degrees and 120 degrees, or about 90 degrees. The abrasives entry direction defined by the abrasives entry passageway and the abrasives exit direction defined by the abrasives exit passageway may each be perpendicular to the axis defined by the fluid jet. A fluid jet cutting head may include the nozzle body and may further comprise: a source of abrasive material coupled to the abrasives entry passageway for supplying the abrasives to be mixed with the fluid jet; and a vacuum source coupled to the abrasives exit passageway to assist in drawing abrasives into the mixing chamber and for withdrawing the abrasives that are not mixed with the fluid jet.

A fluid jet cutting head may include the nozzle body and may further include: the orifice mount, the orifice mount being received within the orifice mount receiving cavity of the nozzle body; a fluid delivery body having a fluid delivery conduit to supply a flow of fluid through the orifice of the orifice mount to generate the fluid jet during operation; and a nozzle having a jet passageway from which to discharge the fluid jet from the fluid jet cutting head. The fluid jet cutting head may further include a plurality of orifice mount adjusters configured to adjust a position of the orifice mount in a plane transverse to an axis defined by the orifice to align the fluid jet generated by the orifice with the jet passageway of the nozzle. The fluid jet cutting head may further comprise: a mixing chamber insert which defines the mixing chamber and further includes: an abrasives inlet passageway extending from an exterior of the mixing chamber insert to the mixing chamber; an abrasives outlet passageway extending from the exterior of the mixing chamber insert to the mixing chamber; and a jet passageway extending from the exterior of the mixing chamber insert to the mixing chamber, and wherein the abrasives outlet passageway intersects the mixing chamber at a withdrawal location that is upstream, with respect to a flow path of a fluid jet through the jet passageway and the mixing chamber, of an entrance location where the abrasives inlet passageway intersects the mixing chamber.

According to yet another embodiment, a mixing chamber insert of a fluid jet cutting head may be summarized as including: a mixing chamber; an abrasives inlet passageway extending from an exterior of the mixing chamber insert to the mixing chamber; an abrasives outlet passageway extending from the exterior of the mixing chamber insert to the mixing chamber; and a jet passageway extending from the exterior of the mixing chamber insert to the mixing chamber, and wherein the abrasives outlet passageway intersects the mixing chamber at a withdrawal location that is upstream, with respect to a flow path of a fluid jet through the jet passageway and the mixing chamber, of an entrance location where the abrasives inlet passageway intersects the mixing chamber.

The abrasives inlet passageway may define an abrasives inlet direction, the abrasives outlet passageway may define an abrasives outlet direction, and a spread angle defined by the abrasives inlet direction and the abrasives outlet direction projected onto a reference plane that is perpendicular to an axis defined by the jet passageway may be between 30 degrees and 150 degrees. A fluid jet cutting head may include the mixing chamber insert and may further include: a nozzle body within which the mixing chamber insert is received; an abrasives feed line coupled to the nozzle body and having an abrasives entry passageway for supplying abrasives to the mixing chamber insert; and an abrasives suction line coupled to the nozzle body and having an abrasives exit passageway for assisting in drawing abrasives into the mixing chamber insert and withdrawing abrasives that are not mixed with the fluid jet out of the mixing chamber insert during operation, and wherein a cross-sectional area of the abrasives entry passageway is smaller than a cross-sectional area of the abrasives exit passageway.

A fluid jet cutting head may include the mixing chamber insert and may further include: a nozzle body having an orifice mount receiving cavity; an orifice mount received within the orifice mount receiving cavity of the nozzle body, the orifice mount comprising an orifice unit having an orifice for generating the fluid jet during operation, the orifice having a circular cross-sectional profile with a diameter that is less than or equal to 0.010 inches; and a nozzle having a jet passageway from which to discharge the fluid jet from the fluid jet cutting head, the jet passageway having a circular cross-sectional profile with a diameter that is less than or equal to 0.015 inches.

A fluid jet cutting head may include the mixing chamber insert and may further include: a nozzle body having an orifice mount receiving cavity; an orifice mount received within the orifice mount receiving cavity of the nozzle body, the orifice mount comprising an orifice unit having an orifice for generating the fluid jet during operation; a nozzle having a jet passageway from which to discharge the fluid jet from the fluid jet cutting head; and a plurality of orifice mount adjusters configured to adjust a position of the orifice mount in a plane transverse to an axis defined by the orifice to align the fluid jet generated by the orifice with the jet passageway of the nozzle.

DETAILED DESCRIPTION

Figure 1:
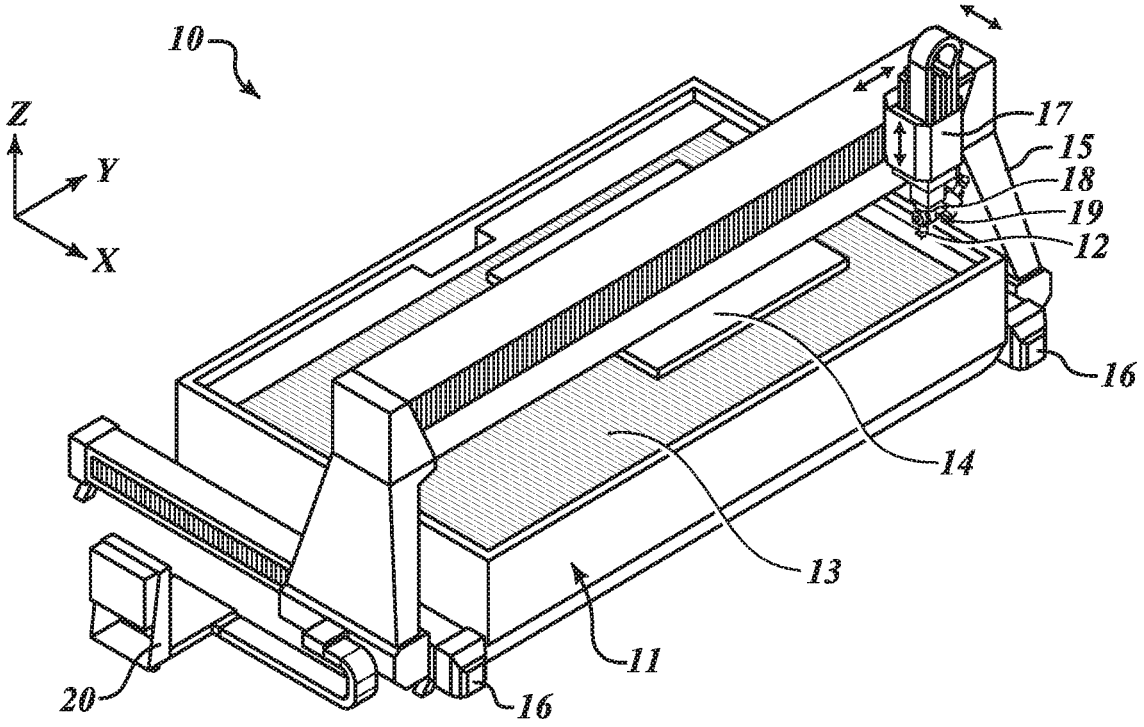
FIG. 1 is a view of an example fluid jet cutting system, according to one embodiment, which comprises a multi-axis manipulator (e.g., gantry motion system) supporting a cutting head assembly at a working end thereof for cutting workpieces.

In the following description, certain specific details are set forth in order to provide a thorough understanding of various disclosed embodiments. However, one of ordinary skill in the relevant art will recognize that embodiments may be practiced without one or more of these specific details. In other instances, well-known structures associated with fluid jet cutting systems and methods of operating the same may not be shown or described in detail to avoid unnecessarily obscuring descriptions of the embodiments. For instance, well-known control systems and drive components may be integrated into the fluid jet cutting systems to facilitate movement of the cutting head assembly relative to the workpiece or work surface to be processed. These systems may include drive components to manipulate the cutting head about multiple rotational and translational axes, as is common in multi-axis manipulators of fluid jet cutting systems. Example fluid jet cutting systems may include a cutting head assembly coupled to a gantry-type motion system, as shown in FIG. 1, a robotic arm motion system, or other motion system for moving the cutting head relative to a workpiece. In other instances, a robotic arm motion system or other motion system may manipulate the workpiece relative to a cutting head.

Unless the context requires otherwise, throughout the specification and claims which follow, the word "comprise" and variations thereof, such as "comprises" and "comprising," are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the context clearly dictates otherwise. It should also be noted that the term "or" is generally employed in its sense including "and/or" unless the context clearly dictates otherwise.

Although some aspects discussed herein may be discussed in terms of waterjets and abrasive waterjets, one skilled in the relevant art will recognize that aspects and techniques of the present invention may apply to other types of fluid jets, generated by high pressure or low pressure, whether or not additives or abrasives are used.

As used herein, the term cutting head or cutting head assembly may refer generally to an assembly of components at a working end of the fluid jet machine or system, and may include, for example, an orifice unit, such as a jewel orifice unit, through which fluid (e.g., water) passes during operation to generate a pressurized fluid jet (e.g., waterjet), a nozzle component for discharging the pressurized fluid jet, and surrounding structures and devices coupled directly or indirectly thereto to move in unison therewith. The cutting head may also be referred to as an end effector.

The fluid jet cutting system may operate in the vicinity of a support structure which is configured to support a workpiece to be processed by the system. The support structure may be a rigid structure or a reconfigurable structure suitable for supporting one or more workpieces in a position to be cut, trimmed or otherwise processed.

FIG. 1 shows an example embodiment of a waterjet cutting system 10. The waterjet cutting system 10 includes a catcher tank assembly 11 having a work support surface 13

(e.g., an arrangement of slats) that is configured to support a workpiece 14 to be processed by the system 10. The waterjet cutting system 10 further includes a bridge assembly 15 which is movable along a pair of base rails 16 and straddles the catcher tank assembly 11. In operation, the bridge assembly 15 can move back and forth along the base rails 16 with respect to a translational axis X to position a cutting head assembly 12 of the system 10 for processing the workpiece 14. A tool carriage 17 may be movably coupled to the bridge assembly 15 to translate back and forth along another translational axis Y, which is aligned perpendicularly to the aforementioned translational axis X. The tool carriage 17 may be configured to raise and lower the cutting head assembly 12 along yet another translational axis Z to move the cutting head assembly 12 toward and away from the workpiece 14. One or more manipulable links or members may also be provided intermediate the cutting head assembly 12 and the tool carriage 17 to provide additional functionality.

As an example, the waterjet cutting system 10 may include a forearm 18 rotatably coupled to the tool carriage 17 for rotating the cutting head assembly 12 about an axis of rotation, and a wrist 19 rotatably coupled to the forearm 18 to rotate the cutting head assembly 12 about another axis of rotation that is non-parallel to the aforementioned rotational axis. In combination, the rotational axes of the forearm 18 and wrist 19 can enable the cutting head assembly 12 to be manipulated in a wide range of orientations relative to the workpiece 14 to facilitate, for example, cutting of complex profiles. The rotational axes may converge at a focal point which, in some embodiments, may be offset from the end or tip of a nozzle component of the cutting head assembly 12.

During operation, movement of the cutting head assembly 12 with respect to each of the translational axes and one or more rotational axes may be accomplished by various conventional drive components and an appropriate control system 20. The control system may generally include, without limitation, one or more computing devices, such as processors, microprocessors, digital signal processors (DSP), application-specific integrated circuits (ASIC), and the like. To store information, the control system may also include one or more storage devices, such as volatile memory, non-volatile memory, read-only memory (ROM), random access memory (RAM), and the like. The storage devices can be coupled to the computing devices by one or more buses. The control system may further include one or more input devices (e.g., displays, keyboards, touchpads, controller modules, or any other peripheral devices for user input) and output devices (e.g., display screens, light indicators, and the like). The control system can store one or more programs for processing any number of different workpieces according to various cutting head movement instructions. The control system may also control operation of other components, such as, for example, a secondary fluid source, a vacuum device and/or a pressurized gas source coupled to the waterjet cutting head assemblies and components described herein. The control system, according to one embodiment, may be provided in the form of a general-purpose computer system. The computer system may include components such as a CPU, various I/O components, storage, and memory. The I/O components may include a display, a network connection, a computer-readable media drive, and other I/O devices (a keyboard, a mouse, speakers, etc.). A control system manager program may be executing in memory, such as under control of the CPU, and may include functionality related to, among other things, routing pressurized water through the waterjet cutting systems described herein, providing a flow of secondary fluid to adjust or modify the coherence of a discharged fluid jet and/or providing a pressurized gas stream to provide for unobstructed waterjet cutting of a workpiece.

Further example control methods and systems for waterjet cutting systems, which include, for example, CNC functionality, and which are applicable to the fluid jet cutting systems described herein, are described in U.S. Pat. No. 6,766,216. In general, computer-aided manufacturing (CAM) processes may be used to efficiently drive or control a cutting head along a designated path, such as by enabling two-dimensional or three-dimensional models of workpieces generated using computer-aided design (i.e., CAD models) to be used to generate code to drive the machines. For example, in some instances, a CAD model may be used to generate instructions to drive the appropriate controls and motors of a fluid jet cutting system to manipulate the cutting head about various translational and/or rotational axes to cut or process a workpiece as reflected in the CAD model. Details of the control system, conventional drive components and other well-known systems associated with fluid jet cutting systems, however, are not shown or described in detail to avoid unnecessarily obscuring descriptions of the embodiments. Other known systems associated with fluid jet cutting systems include, for example, a pressurized fluid source (e.g., direct drive and intensifier pumps with pressure ratings of at least 60,000 psi, at least 90,000 psi, or at least 110,000 psi) for supplying pressurized fluid to the cutting head.

According to some embodiments, the waterjet cutting system 10 includes a pump, such as, for example, a direct drive pump or intensifier pump, to selectively provide a source of pressurized water at an operating pressure of at least 60,000 psi, at least 90,000 psi, or at least 110,000 psi. The cutting head assembly 12 of the waterjet cutting system 10 is configured to receive the high pressure water supplied by the pump and to generate a high pressure waterjet for processing workpieces. A fluid distribution system in fluid communication with the pump and the cutting head assembly 12 is provided to assist in routing pressurized water from the pump to the cutting head assembly 12.

Figure 2:
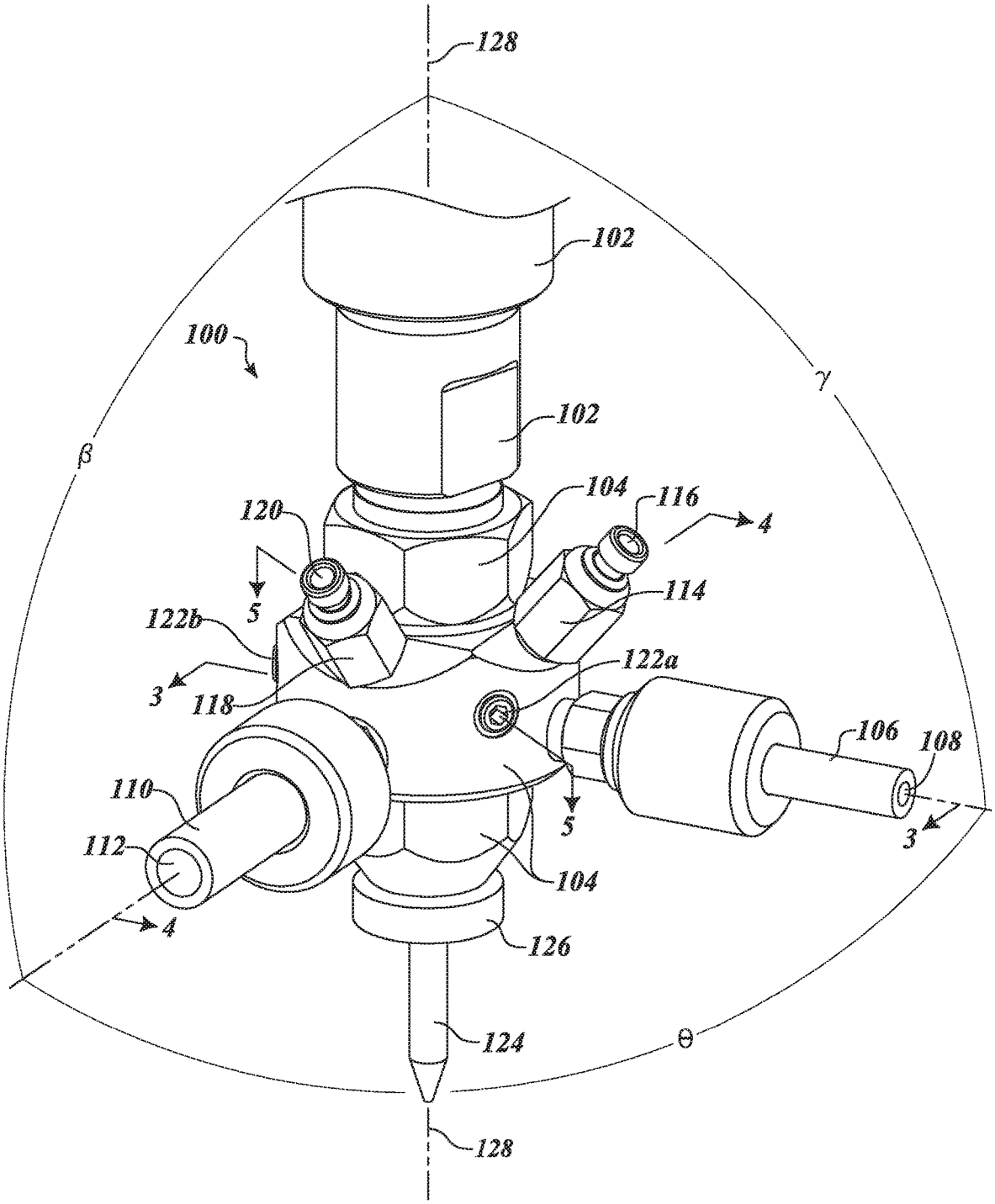
FIG. 2 is a perspective view of an example cutting head assembly, according to one embodiment, which is particularly well suited for cutting brittle, fragile or otherwise sensitive workpieces, and which may be used with the system of FIG. 1.
Figure 3:
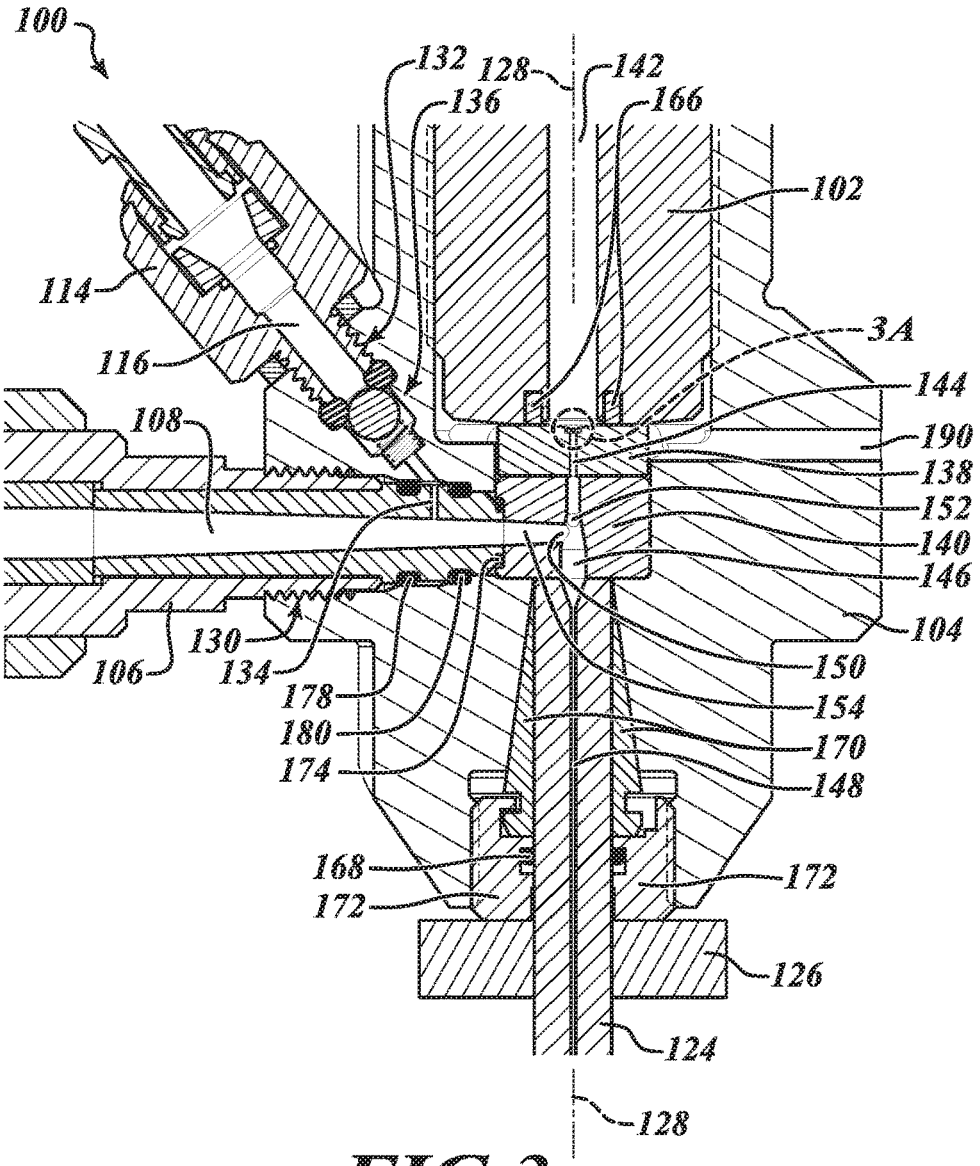
FIG. 3 is a cross-sectional view of the cutting head assembly of FIG. 2 taken along line 3-3 in FIG. 2.
Figure 3A:
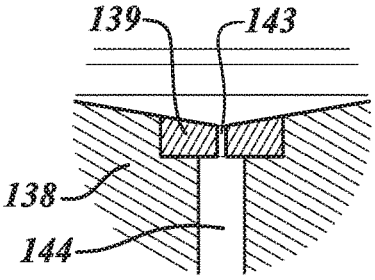
FIG. 3A is an enlarged detail view of a portion of the cross-sectional view of the cutting head assembly of FIG. 3.
Figure 4:
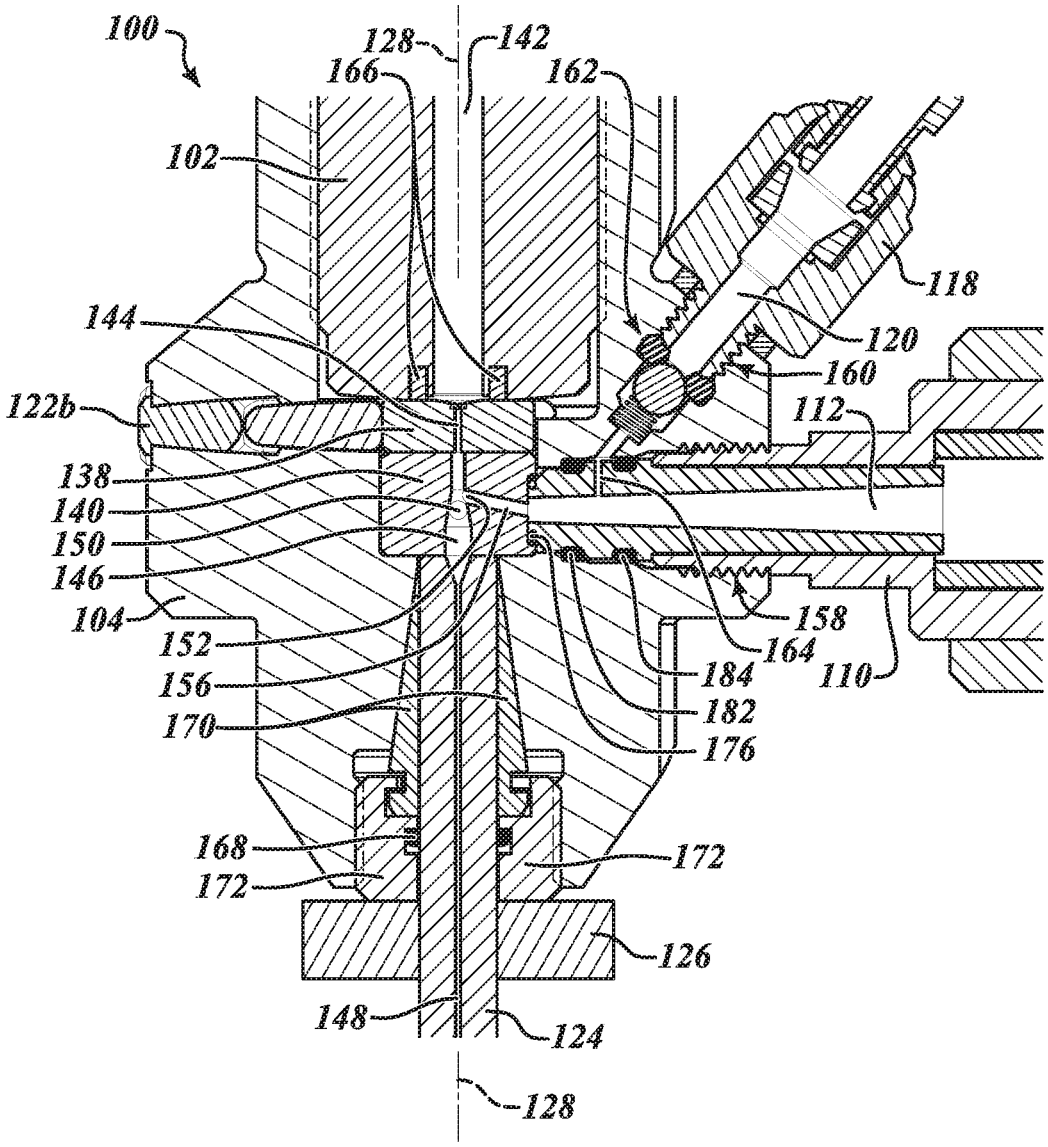
FIG. 4 is a cross-sectional view of the cutting head assembly of FIG. 2 taken along line 4-4 in FIG. 2.

FIGS. 2 through 6 illustrate a cutting head assembly 100 of a waterjet cutting system that is particularly well suited for cutting relatively brittle, fragile or otherwise sensitive materials. As illustrated in FIG. 2, cutting head assembly 100 includes a fluid delivery body 102, such as a high-pressure or an ultra-high-pressure fluid delivery body 102. The fluid delivery body 102 can have a fluid delivery conduit 142, as shown in FIGS. 3 and 4, which can supply pressurized water (or other pressurized fluid) to an orifice 143 (FIG. 3A) to generate a fluid jet to be discharged through the cutting head assembly 100 to cut or otherwise process a workpiece or work surface. For example, the fluid delivery body 102 can receive pressurized water from a pressurized water source, such as a high-pressure or ultrahigh-pressure fluid source (e.g., a direct drive or intensifier pump with a pressure rating of least 60,000 psi, at least 90,000 psi, or at least 110,000 psi).

For purposes of this disclosure, the fluid delivery body 102 can represent an upper end portion of the cutting head assembly 100, with the remaining components of the cutting head assembly 100 positioned at or below the fluid delivery body 102. Cutting head assembly 100 also includes a nozzle body 104, which can house additional components of the cutting head assembly 100, to which other components of the cutting head assembly 100 can be coupled, and through which pressurized water and abrasives can travel and be mixed, as described in further detail elsewhere herein.

FIG. 2 also illustrates that the cutting head assembly 100 includes an abrasives feedline 106 having an abrasives entry passageway 108 extending longitudinally and co-axially therethrough, and which can define an abrasives entry direction into the nozzle body 104. In use, abrasive particles can be fed into the nozzle body 104 to be mixed into a waterjet through the abrasives entry passageway 108. For example, abrasive particles can be fed into the nozzle body 104 from an abrasives source, such as an abrasives hopper and distribution system. The example cutting head assembly 100 also includes a suction line 110 with an exit passageway 112 extending longitudinally and co-axially therethrough, which can define an abrasives exit direction out of the nozzle body 104. In use, excess or unspent abrasive particles that are not mixed into the waterjet can be removed from the nozzle body 104 through the exit passageway 112. In use, a vacuum can be applied to the exit passageway 112, such as by a vacuum device, to assist in drawing abrasive particles from an abrasives source into the nozzle body 104 via the abrasives entry passageway 108 to facilitate the mixing of the abrasive particles into the waterjet. In some implementations, an average cross-sectional area of the abrasives entry passageway 108 can be smaller than an average cross-sectional area of the exit passageway 112 to assist in efficiently removing the excess or unspent abrasives from the nozzle body 104. The abrasive particles may also be efficiently removed from the nozzle body 104 during periods in which the abrasives are flowing but the waterjet is not being discharged from the cutting head 100.

FIG. 2 illustrates that the abrasives feedline 106 and the suction line 110 are each arranged at angles $\beta,\gamma$ that are perpendicular to a central longitudinal axis 128 of the cutting head assembly 100, and to a general direction along which water generally flows through the cutting head assembly 100. Thus, the abrasives entry passageway 108 and the exit passageway 112 are also arranged, and approach and meet the nozzle body 104, at approximately right angles to the central longitudinal axis 128, and to the general direction along which water flows through the cutting head assembly 100. In other embodiments, the abrasives feedline 106 and the suction line 110 may each be arranged at angles $\beta,\gamma$ that are oblique and may be the same or different from each other.

FIG. 2 also illustrates that the abrasives feedline 106 and the suction line 110 are arranged at a spread angle $\theta$ relative to each other of about 90 degrees, as measured about the central longitudinal axis 128, so that the abrasives entry passageway 108 and the exit passageway 112 are also arranged, and approach and meet corresponding ports of the nozzle body 104, at approximately a right angle with respect to one another, as measured about the central longitudinal axis 128. In other embodiments, the abrasives entry passageway 108 and the exit passageway 112, which can define an abrasives entry direction and an exit direction, respectively, can be arranged, and meet corresponding ports of the nozzle body 104, at any suitable spread angle with respect to one another, such as approximately 150°, approximately 135°, approximately 120°, approximately 60°, approximately 45°, approximately 30°, or between approximately 150° and approximately 30°, or between approximately 135° and approximately 45°, or between approximately 120° and approximately 60°. In instances in which the abrasives entry passageway 108 and the exit passageway 112 enter the nozzle body 104 at an oblique angle, the spread angle $\theta$ may be determined by projecting the entry direction and exit direction onto a reference plane that is perpendicular to the axis 128. Such embodiments having the aforementioned spread angle $\theta$ can be advantageous because they can result in abrasives following less direct (i.e., more circuitous or convoluted) flow paths through the cutting head assembly 100 and the mixing chamber 146, shown in FIGS. 3 and 4, which can increase or improve the residence time of the abrasives within the cutting head assembly 100 and the mixing chamber 146, and which can increase or improve the mixing or entraining of the abrasives into the waterjet and decrease an amount of the abrasive material that is wasted or unspent.

FIG. 2 also shows that the cutting head assembly 100 includes an abrasives entry flushing pipeline 114 with an abrasives entry flushing conduit 116 extending longitudinally and co-axially therethrough. In use, water or another fluid can be fed into the abrasives entry passageway 108 through the abrasives entry flushing conduit 116 to flush any waste abrasives that may have become stuck, or otherwise built up, or any other accumulated residue, within the abrasives entry passageway 108, as can be readily appreciated from a review of FIG. 3. The cutting head assembly 100 also includes an abrasives exit flushing pipeline 118 with an abrasives exit flushing conduit 120 extending longitudinally and co-axially therethrough. In use, water or another fluid can be fed into the exit passageway 112 through the abrasives exit flushing conduit 120 to flush any waste abrasives that may have become stuck, or otherwise built up, or any other accumulated residue, within the exit passageway 112, as can be readily appreciated from a review of FIG. 4.

FIG. 2 illustrates that the abrasives entry and exit flushing pipelines 114 and 118 are each arranged at less than right angles (e.g., at 30°, 45°, 60°, or between 30° and 60°) to the central longitudinal axis 128, and such that the abrasives entry and exit flushing pipelines 114 and 118 approach the nozzle body 104 from above the abrasives entry and exit pipelines 106 and 110. Thus, the abrasives entry flushing conduit 116 and the abrasives exit flushing conduit 120 are also arranged, and approach and meet the nozzle body 104, at less than right angles (e.g., at 30°, 45°, 60°, or between 30° and 60°) to the central longitudinal axis 128, and from above the abrasives entry and exit conduits 108 and 112.

FIG. 2 also illustrates that the abrasives entry and exit flushing pipelines 114 and 118 are arranged directly above the abrasives entry and exit pipelines 106, 110, respectively. Thus, the abrasives entry and exit flushing pipelines 114 and 118 are arranged at approximately a right angle with respect to one another, as measured about the central longitudinal axis 128, so that the abrasives entry and exit flushing conduits 116 and 120 are also arranged, and approach and meet corresponding ports of the nozzle body 104, at approximately a right angle with respect to one another, as measured about the central longitudinal axis 128.

FIG. 2 also illustrates that the cutting head assembly 100 includes a first alignment screw **122*a* and a second alignment screw 122*b* (collectively, alignment screws 122). The alignment screws 122 are discussed in further detail elsewhere with reference to FIG. 5. FIG. 2 also illustrates that the cutting head assembly 100 includes a nozzle 124 (also referred to as a mixing tube in the context of abrasive waterjet cutting), from which a waterjet or abrasive waterjet can exit the cutting head assembly 100 at high speed, and a shield 126 surrounding the nozzle 124, which can protect other components of the cutting head assembly 100 from water and abrasive material sprayed back toward the cutting head assembly 100 after colliding with a workpiece or work surface. For purposes of this disclosure, the nozzle 124 can represent a bottom end portion of the cutting head assembly 100, with the remaining components of the cutting head assembly 100 positioned at or above the nozzle 124. The nozzle 124 is discussed in further detail elsewhere with reference to FIG. 6**.

FIG. 3 illustrates a cross-sectional view of the cutting head assembly 100 taken along line 3-3 in FIG. 2, so that internal components of the cutting head assembly 100, such as the arrangement of the abrasives feedline 106 and the abrasives entry flushing pipeline 114, are illustrated. FIG. 4 illustrates a cross-sectional view of the cutting head assembly 100 taken along line 4-4 in FIG. 2, so that internal components of the cutting head assembly 100, such as the arrangement of the suction line 110 and the abrasives exit flushing pipeline 118, are illustrated. FIG. 3A is an enlarged detail view of a portion of the cross-sectional view of FIG. 3, illustrating an orifice unit 139 (e.g., jewel orifice unit), including an orifice 143 for generating a high-pressure fluid jet, which is carried by an orifice mount 138. Although FIG. 3A illustrates the orifice unit 139 as a separate, distinct component that is carried by the orifice mount 138, it is appreciated that in some instances the orifice 143 for generating the high-pressure fluid jet may be formed integrally in the orifice mount 138.

With reference to FIGS. 3 and 4, the cutting head assembly 100 includes the orifice mount 138 positioned within an orifice mount receiving cavity of the nozzle body 104, upon or within which an orifice unit 139, such as a ruby, sapphire, or diamond orifice unit, can be carried or supported. The orifice mount 138 can be positioned directly below, and in sealing contact with, the fluid delivery body 102. The cutting head assembly 100 also includes a mixing chamber insert 140, which can be positioned directly below, and in contact with, the orifice mount 138, and which can be positioned directly above, and in contact with, the nozzle 124.

As also shown in FIGS. 3 and 4, the fluid delivery body 102 can include a fluid delivery conduit 142 extending longitudinally and co-axially therethrough, the orifice mount 138 can include an orifice conduit 144 extending longitudinally and co-axially therethrough, the mixing chamber insert 140 can include a mixing chamber 146 extending longitudinally and co-axially therethrough, and the nozzle 124 can include a jet passageway 148 extending longitudinally and co-axially therethrough. The fluid delivery body 102, its fluid delivery conduit 142, the orifice mount 138, its orifice 143 (FIG. 3A) and orifice conduit 144, the mixing chamber insert 140, its mixing chamber 146, the nozzle 124, and its jet passageway 148 can have respective generally cylindrical profiles that are arranged co-axially with one another and co-axially along the axis 128. Thus, high-pressure water supplied via the fluid delivery body 102 can pass through the orifice 143 of the orifice unit 139 carried by the orifice mount 138 to generate a high-pressure waterjet that passes through the orifice conduit 144 of the orifice mount 138, through the mixing chamber insert 140 (where abrasives can be introduced into the jet), through the nozzle 124, and out of the cutting head assembly 100 to cut or otherwise process a workpiece or work surface.

FIGS. 3 and 4 also show that the mixing chamber insert 140 includes an abrasives inlet conduit 154 (see FIG. 3) that is fluidly coupled to the mixing chamber 146 at an abrasives inlet port 150, and an abrasives outlet conduit 156 (see FIG. 4) that is fluidly coupled to the mixing chamber 146 at an abrasives outlet port 152. As shown in FIGS. 3 and 4, the abrasives inlet port 150 is positioned below the abrasives outlet port 152. In some cases, positioning the abrasives outlet port 152 above the abrasives inlet port 150 can assist in reducing or preventing abrasive particles from entering the orifice conduit 144 or becoming lodged therein. In addition, positioning the abrasives outlet port 152 to be vertically offset from the abrasives inlet port 150 can create a relatively more convoluted or tortuous path to assist in increasing the residence time of abrasive particles in the mixing chamber 146 which can lead to more efficient and consistent entrainment of the abrasive particles in the waterjet.

In some cases, the abrasives outlet port 152 can be in fluid communication with a suction passageway 112 having an average cross-sectional area that is larger than the average cross-sectional area of the abrasives feed passageway 108 that is in fluid communication with the abrasives inlet port 150, such as by about 10%, 20%, 30% or greater, which can improve the ability of the cutting head assembly 100 to remove excess or unspent abrasive particles from the mixing chamber 146.

Further, the abrasives inlet and outlet ports 150, 152 may be positioned at a spread angle with respect to one another, as measured about the central longitudinal axis 128, to correspond to the arrangement of the abrasives feedline 106 and the suction line 110.

As shown in FIG. 3, the abrasives feedline 106 is coupled to an abrasives entry port 130 formed in a side of the nozzle body 104, and the abrasives entry flushing pipeline 114 is coupled to a flushing port 132 formed in the side of the nozzle body 104. In particular, the abrasives feedline 106 is coupled to the abrasives entry port 130 to allow flow of fluid from the conduit 108 into the nozzle body 104 and the mixing chamber 146 through the abrasives inlet conduit 154 and the abrasives inlet port 150, and the abrasives entry flushing conduit 116 is fluidly coupled to an inlet of a spring-loaded ball check valve 136 at the flushing port 132 to enable selective flushing of the abrasives inlet conduit 154 and surrounding area during operation.

As shown in FIG. 4, the suction line 110 is coupled to a suction port 158 formed in the side of the nozzle body 104, and the abrasives exit flushing pipeline 118 is coupled to a flushing port 160 formed in the side of the nozzle body 104. In particular, the suction line 110 is coupled to the suction port 158 to allow flow of fluid from nozzle body 104 and the mixing chamber 146 into the exit passageway 112 through the abrasives outlet port 152 and the abrasives outlet conduit 156, and the abrasives exit flushing conduit 120 is fluidly coupled to an inlet of a spring-loaded ball check valve 162 at the flushing port 160 to enable selective flushing of the abrasives outlet conduit 156 and surrounding area during operation.

Thus, abrasive particles can be fed into the cutting head assembly 100 through the abrasives feedline 106, through the inlet conduit 154 and the inlet port 150, and into the mixing chamber 146, where a portion of the abrasive particles can become mixed into and entrained within the waterjet as it passes through the mixing chamber 146 to form an abrasive waterjet. A remaining portion of the abrasive particles that does not become entrained within the waterjet can be removed from the cutting head assembly 100, such as under the suction created by a vacuum applied to the suction line 110, from the mixing chamber 146 through the outlet port 152 and the outlet conduit 156, and through the suction line 110. In addition, in accordance with one or more embodiments, abrasive particles can be fed into the cutting head assembly 100 through the abrasives feedline 106 continuously, including during periods when a jet is not being discharged from the cutting head assembly 100, such as may occur during intermittent cutting activities. In this manner, the jet may be cycled on and off without disrupting the feed of abrasives to the cutting head assembly 100.

With reference to FIG. 3, the abrasives feedline 106 includes an upstream flushing conduit 134 that extends radially outward from the abrasives entry passageway 108 to an exterior surface of the abrasives feedline 106. The upstream flushing conduit 134 is also fluidly coupled to the flushing port 132 by an outlet of the check valve 136. Thus, the upstream flushing conduit 134 can be used to flush abrasives that build up over time within the cutting head assembly 100 in locations upstream, with respect to a flow path of abrasives through the cutting head assembly 100, of the mixing chamber 146, by supplying water or another fluid to the abrasives entry flushing conduit 116 under sufficient pressure to open the check valve 136, so that the water or other fluid can pass into the abrasives entry passageway 108 and remove debris from within the abrasives entry passageway 108.

With reference to FIG. 4, the suction line 110 includes a downstream flushing conduit 164 that extends radially outward from the abrasives exit passageway 112 to an exterior surface of the suction line 110. The downstream flushing conduit 164 is also fluidly coupled to the flushing port 160 by an outlet of the check valve 162. Thus, the downstream flushing conduit 164 can be used to flush abrasives that build up over time within the cutting head assembly 100 in locations downstream, with respect to the flow path of abrasives through the cutting head assembly 100, of the mixing chamber 146, by supplying water or another fluid to the abrasives exit flushing conduit 120 under sufficient pressure to open the check valve 162, so that the water or other fluid can pass into the abrasives exit passageway 112 and remove debris from within the abrasives exit passageway 112.

FIGS. 3 and 4 also show that the cutting head assembly 100 includes a plurality of seals at interfaces between various components of the cutting head assembly 100. For example, the cutting head assembly 100 includes a face seal 166, which can be an o-ring seal, that extends circumferentially around the axis 128 and the path of water through the cutting head assembly 100, and that seals an interface between the fluid delivery body 102 and the orifice mount 138 to prevent or reduce high-pressure water from escaping from the supply conduit 142 between the fluid delivery body 102 and the orifice mount 138.

FIG. 3 also shows that the nozzle body 104 may include a relief conduit 190 that vents to the surrounding environment to prevent pressure from building up around the exterior of the orifice mount 138 within the nozzle body 104. FIGS. 3 and 4 illustrate that the face seal 166 is seated primarily within a groove in a bottom surface of the fluid delivery body 102, but in other embodiments, the face seal 166 can be seated primarily within a groove in an upper surface of the orifice mount 138, or can be seated within a groove in a bottom surface of the fluid delivery body 102 and a groove in an upper surface of the orifice mount 138.

Further, with reference to FIGS. 3 and 4, the example cutting head assembly 100 further includes a collet 170 and an actuator 172. The actuator 172 is threadedly engaged with the nozzle body 104 so that the actuator 172 can be rotated about the axis 128 and threaded into the nozzle body 104, thereby urging the collet 170 to move upward along the axis 128 and through a decreasing-diameter (e.g., tapered) opening in the nozzle body 104 toward the mixing chamber insert 140. As the collet 170 moves upward, it is squeezed between an inner surface of the nozzle body 104 and an outer surface of the nozzle 124, and thus grips the nozzle 124, securing the nozzle 124 within the nozzle body 104 and positioning an upper surface of the nozzle 124 against a lower surface of the mixing chamber insert 140.

The cutting head assembly 100 also includes a seal 168 seated within a groove formed in an inner surface of the actuator 172, such that the seal 168 and the groove within which it is seated extend circumferentially around the axis 128 and the path of water through the cutting head assembly 100, and such that the seal 168 seals an interface between the nozzle 124 and the actuator 172.

Further, with reference to FIG. 3, the cutting head assembly 100 includes a seal 174 that extends circumferentially around the abrasives flow path where the abrasives flow path transitions between the abrasives entry passageway 108 and the abrasives inlet conduit 154 of the mixing chamber insert 140, and that seals an interface between the abrasives feedline 106 and the mixing chamber insert 140 to prevent abrasive or other materials passing through the abrasives feedline 106 from escaping between the abrasives feedline 106 and the mixing chamber insert 140. Similarly, with reference to FIG. 4, the cutting head assembly 100 includes a seal 176 that extends circumferentially around the abrasives flow path where the abrasives flow path transitions between the abrasives outlet conduit 156 of the mixing chamber insert 140 and the suction line 110, and that seals an interface between the suction line 110 and the mixing chamber insert 140 to prevent abrasive or other materials passing through the suction line 110 from escaping between the suction line 110 and the mixing chamber insert 140. The seals 168, 174, and 176 can allow a vacuum to be more effectively drawn within the mixing chamber 146.

Further, with reference to FIG. 3, the cutting head assembly 100 includes a seal 178 that extends circumferentially around the abrasives flow path just upstream, with respect to the abrasives flow path, of the upstream flushing conduit 134, and that seals an interface between the abrasives feedline 106 and the nozzle body 104 to prevent abrasive, water, or other materials from escaping between the abrasives feedline 106 and the nozzle body 104, and especially to prevent water flowing from the abrasives entry flushing conduit 116 to the abrasives entry passageway 108 from escaping. The cutting head assembly 100 also includes a seal 180 that extends circumferentially around the abrasives flow path just downstream, with respect to the abrasives flow path, of the upstream flushing conduit 134, and that seals an interface between the abrasives feedline 106 and the nozzle body 104 to prevent abrasive, water, or other materials from escaping between the abrasives feedline 106 and the nozzle body 104, and especially to prevent water flowing from the abrasives entry flushing conduit 116 to the abrasives entry passageway 108 from escaping.

Similarly, with reference to FIG. 4, the cutting head assembly 100 includes a seal 182 that extends circumferentially around the abrasives flow path just upstream, with respect to the abrasives flow path, of the downstream flushing conduit 164, and that seals an interface between the suction line 110 and the nozzle body 104 to prevent abrasive, water, or other materials from escaping between the suction line 110 and the nozzle body 104, and especially to prevent water flowing from the abrasives exit flushing conduit 120 to the exit passageway 112 from escaping. The cutting head assembly 100 also includes a seal 184 that extends circumferentially around the abrasives flow path just downstream, with respect to the abrasives flow path, of the downstream flushing conduit 164, and that seals an interface between the suction line 110 and the nozzle body 104 to prevent abrasive, water, or other materials from escaping between the suction line 110 and the nozzle body 104, and especially to prevent water flowing from the abrasives exit flushing conduit 120 to the abrasives exit passageway 112 from escaping.

Figure 5:
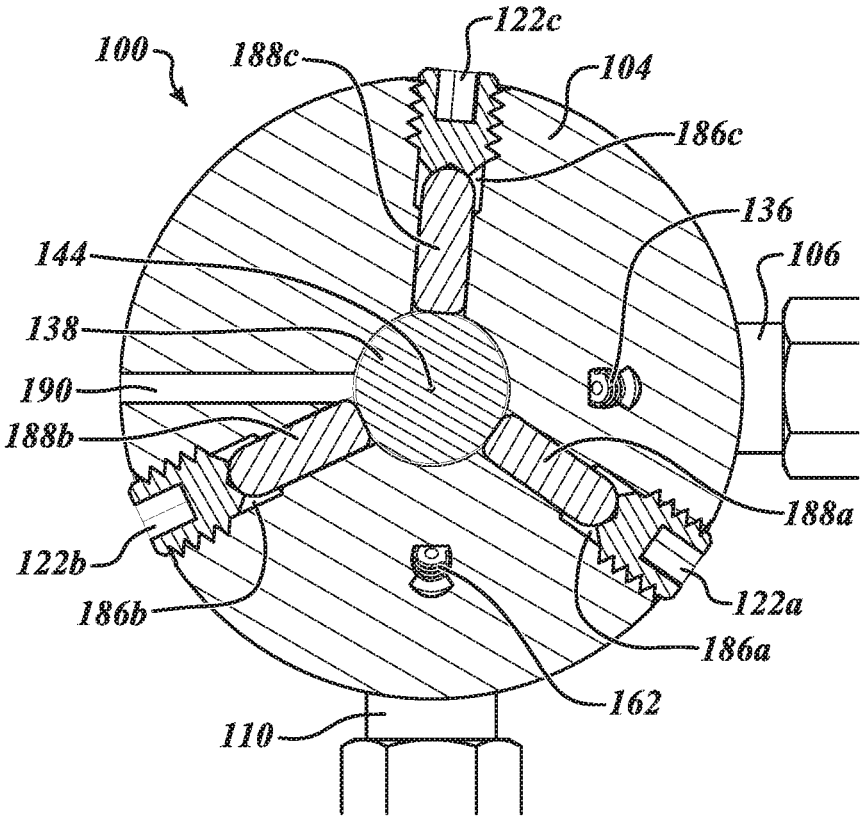
FIG. 5 is a cross-sectional view of the cutting head assembly of FIG. 2 taken along line 5-5 in FIG. 2.

FIG. 5 provides a cross-sectional view of the cutting head assembly 100 taken along line 5-5 in FIG. 2. As illustrated in FIG. 5, the nozzle body 104 includes three ducts 186*a*, 186*b*, and 186*c* (collectively, ducts 186) that extend radially inward from an outer surface of the nozzle body 104 to an inner surface of the nozzle body 104, which is adjacent to the orifice mount 138. The ducts 186 are spaced circumferentially equidistantly apart from one another, e.g., at about 120° apart from one another with respect to the axis 128, around the orifice conduit 144. FIG. 5 also shows that the cutting head assembly 100 includes three adjustment pins 188*a*, 188*b*, 188*c* (collectively, adjustment pins 188), each having a generally cylindrical shape, positioned within inner or central portions of the ducts 186*a*, 186*b*, and 186*c*, respectively, and in contact with the orifice mount 138.

First, second, and third alignment screws 122*a*, 122*b*, and 122*c* (collectively, alignment screws 122) are positioned within outer or peripheral portions of the ducts 186*a*, 186*b*, and 186*c*, and in contact with the respective adjustment pins 188. The first alignment screw 122*a* and the first adjustment pin 188*a* can be referred to collectively as a first orifice mount adjuster, the second alignment screw 122*b* and the second adjustment pin 188*b* can be referred to collectively as a second orifice mount adjuster, and the third alignment screw 122*c* and the third adjustment pin 188*c* can be referred to collectively as a third orifice mount adjuster.

By screwing the alignment screws 122 into or out of the respective ducts 186, an operator can use the alignment screws 122 and the pins 188 to finely adjust the position of the orifice mount 138, and orifice 143 thereof, within the nozzle body 104, such as within a plane that is transverse or perpendicular to an axis defined by the orifice 143 or to the axis 128, such as to align the fluid jet generated by the orifice 143 with the jet passageway 148 of the nozzle 124. For example, the operator can use the screws 122 and the pins 188 to adjust the position of the orifice mount 138 so that the orifice mount 138 is laterally aligned with both the mixing chamber insert 140 and the nozzle 124, and so that the orifice 143 is aligned with both the mixing chamber 146 and the jet passageway 148, so that a waterjet can pass through the orifice conduit 144, the mixing chamber 146, and the jet passageway 148 without or with minimally contacting the mixing chamber insert 140 or the nozzle 124.

As described further below, in some implementations, an operator can make such adjustments while testing the alignment of the various components by providing relatively low-pressure water (e.g., at 1,000 psi) to the supply conduit 142, and once a suitable alignment of the components has been achieved, providing higher-pressure water to the supply conduit 142 to begin using the cutting head assembly 100 to cut or otherwise process a workpiece or work surface. Such techniques can become increasingly important in embodiments in which an inner diameter of the jet passageway 148 of the nozzle 124 approaches the diameter of an abrasive water jet passing through the nozzle 124.

Figure 6:
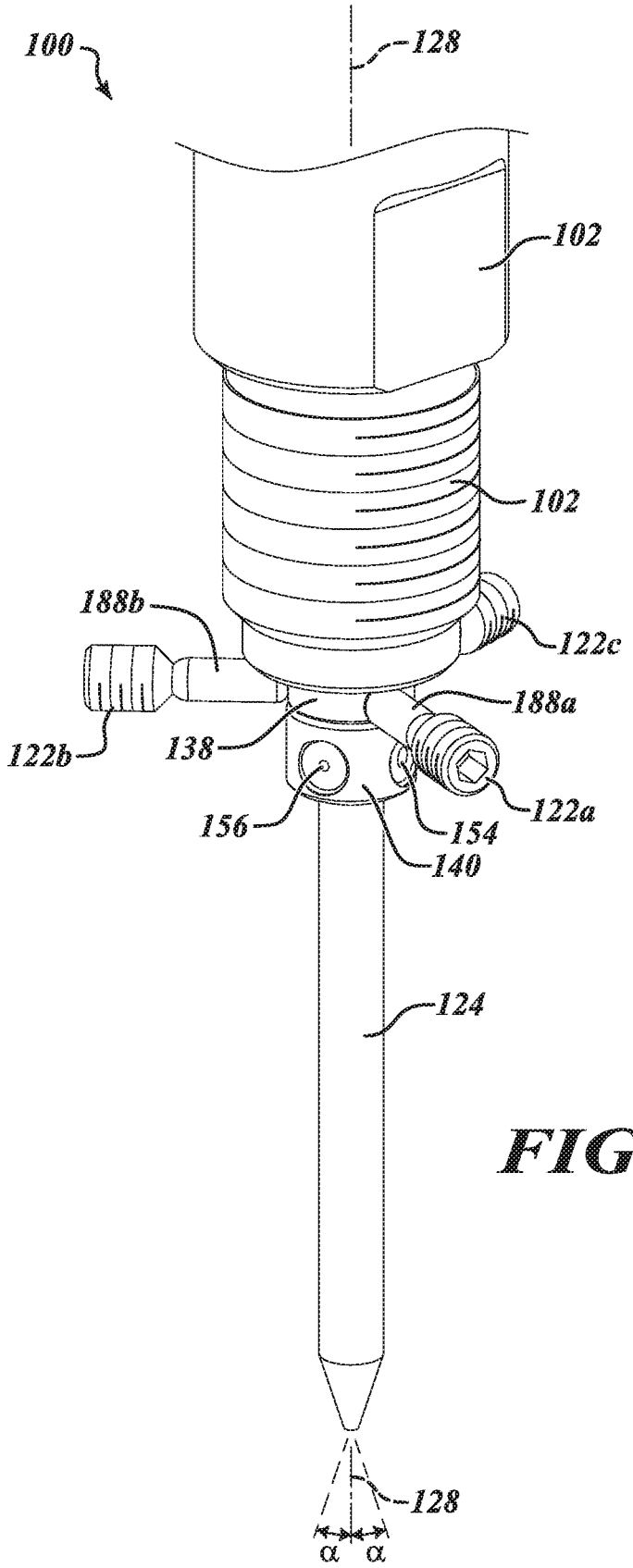
FIG. 6 is an enlarged perspective view of the cutting head assembly of FIG. 2 with a nozzle body and other components of the cutting head assembly removed to reveal additional details.

FIG. 6 provides an enlarged isometric view of a portion of the cutting head assembly 100, with the nozzle body 104, the abrasives feedline 106, the abrasives suction line 110, the abrasives entry flushing pipeline 114, the abrasives exit flushing pipeline 118, and other components removed, to more clearly illustrate other features of the cutting head assembly 100.

For example, the orifice mount 138 is shown with adjustment devices (e.g., screws 122*a*-122*c* and the pins 188*a*-188*c*) located around the outer circumferential profile of the orifice mount 138 to enable fine adjustment of the axial location of the orifice 143 of the orifice unit 139 carried thereby relative to the jet passageway 148 of the nozzle 124. In some instances, the adjustment devices may be configured so as to enable axial alignment of the orifice 143 relative to the jet passageway 148 of the nozzle 124 with less than 0.0010 inches of offset misalignment, or with less than or equal to 0.0005 inches of offset misalignment. Precise axial alignment of the orifice 143 with the jet passageway 148 can assist in reducing jet hydrodynamic loads on the material being cut by avoiding or minimizing bias at the jet/material interface, which in turn can reduce, minimize or eliminate surface and sub-surface defects when cutting particularly sensitive materials.

As another example, the mixing chamber insert 140 is shown with one exposed mounting face at the end of the abrasives inlet conduit 154 for coupling the abrasives feedline 106 to the mixing chamber insert 140 for supplying abrasives thereto during operation, and another exposed mounting face at the end of the abrasives outlet conduit 156 for coupling the suction line 110 to the mixing chamber insert 140 for assisting in drawing abrasives into the mixing chamber insert 140 and withdrawing unused abrasives during operation.

FIG. 6 also illustrates that a distal end of the nozzle 124 may be tapered at an angle $\alpha$ to the axis 128, where a can be greater than 5°, 10°, 15°, 20°, 25°, or 30°, and/or where a can be less than 35°, 30°, 25°, 20°, 15°, 10°, or 5°.

As will be readily apparent to those of ordinary skill in the art of fluid jet cutting, various methods of operating a fluid jet cutting system may be provided in connection with the various systems and components disclosed herein.

For example, methods of operating the cutting head assembly 100 to cut a workpiece or a series of workpieces can include supplying abrasive particles to the cutting head assembly 100 through the abrasives feedline 106, and drawing the abrasive particles through the cutting head assembly 100, including through the mixing chamber insert 140 along the abrasives flow path, and out of the cutting head assembly 100 through the abrasives suction line 110 by applying a vacuum to the abrasives suction line 110. Such methods can include supplying the abrasives to and drawing the abrasives through the cutting head assembly 100 continuously during operation of the cutting head assembly 100, while a waterjet is passing through the mixing chamber 146, and while a waterjet is not passing through the mixing chamber 146, so that the waterjet can be cycled on and off while the abrasive particles continue to flow through the cutting head assembly 100.

Such methods can reduce the amount of time it takes to establish a suitable abrasive waterjet and can improve the consistency of the abrasive waterjet over the course of multiple cutting operations. For example, such methods can reduce the time it takes to make a cut in a workpiece by a couple of seconds, which can amount to a large cost savings over time, particularly when cutting high-volume and/or high-throughput workpieces such as printed circuit boards.

Methods of operating the cutting head assembly 100 to cut a workpiece or a series of workpieces can also include selectively supplying water to the abrasives entry flushing conduit 116 and to the abrasives exit flushing conduit 120 under sufficient pressure to open the check valves 136 and 162. Such methods can include flushing water into the conduits 108 and 112 while drawing a vacuum on the abrasives exit passageway 112 to clean and flush abrasives or other residues built up within the cutting head assembly 100 out of the cutting head assembly 100 in the form of slurry of abrasives and other residues. Such flushing can be performed periodically, such as at regular intervals, or at times when the cutting head assembly 100 is not generating a waterjet to cut a workpiece. Such flushing via the abrasives exit flushing conduit 120 can be performed continuously, even while the cutting head assembly 100 is generating a waterjet and cutting a workpiece. Such techniques can improve the consistency of abrasives flow through the cutting head assembly 100.

Methods of operating the cutting head assembly 100 to cut a workpiece or a series of workpieces can also include using adjustment devices (e.g., screws 122 and the pins 188) to adjust a location and an alignment of the orifice mount 138 within the nozzle body 104. For example, the orifice mount 138 can be positioned roughly within the nozzle body 104, and the nozzle body 104 can be coupled to the fluid delivery body 102 relatively loosely, so that the orifice mount 138 can be moved within the nozzle body 104, but sufficiently securely to engage the face seal 166 to create at least a low-pressure seal between the fluid delivery body 102 and the orifice mount 138. A relatively low-pressure water (e.g., at an alignment pressure of 1,000 psi) can then be provided to the supply conduit 142 to create a relatively low-pressure water jet to test the alignment of the orifice mount 138, the mixing chamber insert 140, and the nozzle 124. An alignment of the low pressure water jet with the jet passageway 148 of the nozzle 124 can then be observed, and the position of the screws 122 can then be adjusted to push the pins 188 through the ducts 186 to adjust a location of the orifice mount 138 as needed based on the testing and observations.

Once a suitable alignment of the orifice mount 138 with the other components has been achieved and a desired alignment of the orifice mount 138 is confirmed (e.g., less than 0.001 inches of offset misalignment between an axis of the orifice 143 and an axis of the jet passageway 148 of the nozzle 124), the nozzle body 104 can be coupled to the fluid delivery body 102 more securely (such as by further threading the nozzle body 104 onto the fluid delivery body 102), so that the orifice mount 138 is fixed and cannot be moved within the nozzle body 104, and so that the face seal 166 creates a high-pressure seal between the fluid delivery body 102 and the orifice mount 138. The more secure coupling of the fluid delivery body 102 to the nozzle body 104 can be achieved by manipulating the nozzle body 104 relative to the fluid delivery body 102, such as by applying a torque to the nozzle body 104 to thread the nozzle body 104 onto the fluid delivery body 102. In other instances, the fluid delivery body 102 and the nozzle body 104 may be coupled together in a torqueless manner, or in a manner that does not apply a torque to the orifice mount 138.

Such methods can be used to position the orifice 143 of the orifice mount 138 with respect to the jet passageway 148 of the nozzle 124 such that the orifice 143 and the jet passageway 148 are axially aligned with less than 0.0020 inches, less than 0.0015 inches, or less than 0.0010 inches of offset misalignment. Such techniques can reduce or eliminate the extent to which such operations disturb the location of the orifice mount 138 within the nozzle body 104 after the orifice mount 138 has been properly positioned and aligned within the nozzle body 104. Again, such precise locating of the orifice 143 of the orifice mount 138 with respect to the jet passageway 148 of the nozzle 124 can assist in reducing jet hydrodynamic loads on the material while cutting by avoiding bias at the jet/material interface.

According to some embodiments, abrasive waterjets are generated at relatively higher pressures to maintain suitable power levels while utilizing particularly small jets. For instance, a flow of water at a much higher pressure (e.g., an operating pressure of at least 90,000 psi) can be provided to the supply conduit 142 to generate a high-pressure waterjet at the orifice 143 for cutting a workpiece of a particularly sensitive material with a relatively small abrasive waterjet.

For example, methods of operating the cutting head assembly 100 to cut a workpiece or a series of workpieces can also include using relatively a small-diameter nozzle 124 (e.g., a mixing tube having a jet passageway with a circular cross-sectional profile with a diameter of less than or equal to 0.015", 0.010", 0.008", or 0.006") and relatively small abrasive particle sizes to create a relatively small-diameter abrasive waterjet (e.g., a waterjet having a diameter of less than or equal to 0.015", 0.010", 0.008", or 0.006"), to reduce impact forces imparted to the workpiece by the abrasive waterjet. Further, such methods can also include supplying relatively high-pressure water (e.g., greater than 90,000 psi) to the fluid delivery conduit 142, and using relatively low water flow rates to the supply conduit 142, to further reduce impact forces imparted to the workpiece by the abrasive waterjet. Lower water flow rates in general, or lower water flow rates relative to conventional cutting techniques at the same power level, present a lower risk for delamination or chipping when cutting particularly fragile materials such as printed circuit boards.

Such methods can include using a nozzle 124 having an inner diameter of the jet passageway 148 of about, or less than, 0.015 inches, of about, or less than, 0.010 inches, of about, or less than, 0.008 inches, of about, or less than, 0.006 inches, using an orifice 143 having a circular cross-sectional profile with a diameter of about, or less than, 0.010 inches, of about, or less than, 0.005 inches, of about, or less than, 0.003 inches, of about, or less than, 0.002 inches, or of about, or less than, 0.001 inches, using abrasive particles having diameters of about, or less than, one third the inner diameter of the jet passageway 148 of the nozzle 124, or in the range of 220-mesh or finer, using abrasive particles at a rate of about, or less than, half a pound per minute, and supplying water to the supply conduit 142 at a pressure of about, or greater than 60,000 psi, of about, or greater than 70,000 psi, of about, or greater than, 80,000 psi, or of about, or greater than, 90,000 psi. Cutting with a relatively small orifice 143 and jet passageway 148 and with increased pressure relative to conventional cutting techniques can provide suitable cutting power with reduced jet loads on the workpiece to enable cutting of sensitive materials at acceptable production rates with little or no appreciable damage such as chipping and delamination.

In some implementations, a ratio of the diameter of the jet passageway 148 of the nozzle 124 to the diameter of the orifice 143 of the orifice unit 139 may be less than or equal to 3.0 and greater than or equal to 1.5. For example, in some embodiments, the methods can include using a nozzle 124 having an inner diameter of the jet passageway 148 that is about twice the diameter of the orifice 143, to increase the concentration of the abrasives in the abrasive waterjet, and to reduce a kerf width of the cut to be formed in the workpiece.

In implementations in which the cutting head assembly 100 is used to cut a slot in a workpiece, such methods can include using a nozzle 124 having an inner diameter of the jet passageway 148 corresponding to, or that approximates, a width of the slot to be cut, so that the cutting head assembly 100 can cut the slot in one pass rather than needing to cut each side of the slot in a different pass of the cutting head assembly 100. For example, such a nozzle 124 can have an inner diameter that is within 10% of, e.g., that is 10% less than, the width of such a slot. Other features may be cut with correspondingly sized jets to increase cutting efficiencies.

Methods can also include creating a highly concentric abrasive waterjet as discussed elsewhere to assist in reducing jet hydrodynamic loads on the material while cutting by avoiding bias at the jet/material interface.

Methods can also include supplying abrasive material to the mixing chamber 146 at relatively higher concentrations of abrasive material when compared to conventional cutting techniques. For example, in some instances, methods may include establishing a mass flow rate of abrasives that is about, or greater than, 13%, 15%, 20%, or 25% of a mass flow rate of water through the mixing chamber 146.

Methods may include cutting a workpiece at a stand-off distance of about, or less than, 2 mm. The methods may also include using a stream of air to keep the region of the workpiece that is to be cut clean and free of water and debris from the cutting operation.

Such methods can also include initiating, originating, or terminating a cut in a workpiece at locations where holes or openings in the workpiece will be subsequently located, so as to reduce or prevent the formation of keyholes in the workpiece at the start or at the end of the cut, and can also include planning cut paths and planning the timing of the starting and stopping of a waterjet to prevent chipping of the workpiece at the ends of the cut path. In some cases, such holes or openings in the workpiece can be created by an abrasive waterjet subsequent to originating a cut within an interior of the hole or opening to be formed.

In some implementations, the cutting head assembly 100 can include a camera, and such methods can include using the camera to identify reference fiducials on the workpiece and using such identification to at least partially control a cutting path of the abrasive waterjet.

The methods disclosed herein can be used to cut printed circuit boards, sheets of glass, or other fragile, brittle or otherwise sensitive materials. In one specific implementation, such methods can include using an orifice 143 having a diameter of 0.0030±0.0005 inches, using a nozzle 124 with a jet passageway 148 having an inner diameter of 0.008±0.001 inches or 0.010±0.001 inches, using 320-mesh abrasive particles, and supplying water to the supply conduit 142 at a nominal operating pressure of about 90,000 psi, to create an abrasive waterjet characterized by a relatively low load to cut a printed circuit board or a sheet of glass with little to no appreciable damage (e.g., chipping, delamination). It has been found that such an implementation results in an impact force of about 0.9 lbs. being imparted to the workpiece when cutting at a 90 degree standoff angle. This may be contrasted with conventional techniques that impart a load of three to four times as much impact force.

Overall, features and aspects of the various embodiments of the abrasive waterjet systems, components and related methods disclosed herein can facilitate the cutting of brittle, fragile, or otherwise sensitive materials with a relatively low load abrasive waterjet to minimize or substantially eliminate edge defects such as chipping or delamination. Features and aspects of the various embodiments of the abrasive waterjet systems, components and related methods may also increase the efficiency of cutting operations as compared to state of the art machining techniques.

Moreover, it is appreciated that features and aspects of the various embodiments described above can be combined to provide yet further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A fluid jet cutting head comprising:

a nozzle body;

an orifice mount received within the nozzle body, the orifice mount including an orifice unit having an orifice for generating a fluid jet during operation, the orifice having a circular cross-sectional profile with a diameter that is less than or equal to 0.010 inches;

a fluid delivery body having a fluid delivery conduit to supply a flow of high pressure fluid to the orifice of the orifice mount to generate the fluid jet during operation;

a mixing chamber insert including a mixing chamber provided downstream of the orifice mount in a path of the fluid jet, the mixing chamber being configured to receive abrasives to be mixed with the fluid jet generated by the orifice of the orifice mount to form an abrasive fluid jet, the mixing chamber insert further including an abrasives inlet conduit through which abrasives flow to the mixing chamber during operation, and an abrasives outlet conduit through which abrasives flow from the mixing chamber during operation, a location of an intersection of the abrasives inlet conduit with the mixing chamber being provided downstream from a location of an intersection of the abrasives outlet conduit with the mixing chamber with respect to the path of the fluid jet;

a nozzle having a jet passageway from which to discharge the abrasive fluid jet from the fluid jet cutting head during operation, the jet passageway having a circular cross-sectional profile with a diameter that is less than or equal to 0.015 inches; and a plurality of adjustment pins, each actuable to move the orifice mount relative to the nozzle and along a respective direction within a plane transverse to an axis defined by the orifice, wherein the respective direction of each of the plurality of adjustment pins is angularly offset from the respective direction of the others of the plurality of adjustment pins.

2. The fluid jet cutting head of claim 1 wherein the orifice of the orifice mount and the jet passageway of the nozzle are axially aligned with less than 0.001 inches of offset misalignment.

3. The fluid jet cutting head of claim 1 wherein the diameter of the orifice is less than or equal to 0.005 inches and the diameter of the jet passageway is less than 0.010 inches.

4. The fluid jet cutting head of claim 1 wherein the diameter of the orifice is less than or equal to 0.003 inches and the diameter of the jet passageway is less than 0.008 inches.

5. The fluid jet cutting head of claim 1 wherein the diameter of the orifice is less than or equal to 0.002 inches and the diameter of the jet passageway is less than 0.006 inches.

6. The fluid jet cutting head of claim 1, further comprising:

a plurality of set screws, wherein each of the plurality of set screws is paired with one of the plurality of adjustment pins to cooperatively form a respective one of a plurality of orifice mount adjusters that is actuable to align the fluid jet generated at the orifice with the jet passageway of the nozzle.

7. The fluid jet cutting head of claim 6 wherein each of the plurality of set screws is rotatable, about a respective axis that lies within the plane and is aligned with the respective direction, to move the orifice mount.

8. A fluid jet cutting head comprising:

a nozzle body;

an orifice mount received within the nozzle body, the orifice mount including an orifice unit having an orifice for generating a fluid jet during operation, the orifice having a circular cross-sectional profile with a diameter that is less than or equal to 0.010 inches;

a fluid delivery body having a fluid delivery conduit to supply a flow of high pressure fluid to the orifice of the orifice mount to generate the fluid jet during operation;

a mixing chamber insert including a mixing chamber provided downstream of the orifice mount in a path of the fluid jet, the mixing chamber being configured to receive abrasives to be mixed with the fluid jet generated by the orifice of the orifice mount to form an abrasive fluid jet, the mixing chamber insert including the mixing chamber through which the fluid jet passes during operation, an abrasives inlet conduit through which abrasives flow to the mixing chamber during operation, and an abrasives outlet conduit through which abrasives flow from the mixing chamber during operation, wherein the abrasives outlet conduit diverges from the path of the fluid jet, and a location of an intersection of the abrasives inlet conduit with the mixing chamber being vertically offset from a location of an intersection of the abrasives outlet conduit with the mixing chamber;

a nozzle having a jet passageway from which to discharge the abrasive fluid jet from the fluid jet cutting head during operation, the jet passageway having a circular cross-sectional profile with a diameter that is less than or equal to 0.015 inches; and a plurality of adjustment pins, each actuable to move the orifice mount relative to the nozzle and along a respective direction within a plane transverse to an axis defined by the orifice, wherein the respective direction of each of the plurality of adjustment pins is angularly offset from the respective direction of the others of the plurality of adjustment pins.

9. The fluid jet cutting head of claim 1 wherein the nozzle body comprises:

an abrasives entry passageway extending from an exterior of the nozzle body toward the mixing chamber for supplying abrasives to be mixed with the fluid jet generated at the orifice during operation, the abrasives entry passageway fluidly coupled to the abrasives inlet conduit and the abrasives entry passageway defining an abrasives entry direction toward the abrasives inlet conduit; and an abrasives exit passageway extending from the exterior of the nozzle body toward the mixing chamber for withdrawing abrasives that are not mixed with the fluid jet, the abrasives exit passageway fluidly coupled to the abrasives outlet conduit and the abrasives exit passageway defining an abrasives exit direction away from the abrasives outlet conduit, and wherein a spread angle defined by the abrasives entry direction and the abrasives exit direction projected onto a reference plane that is perpendicular to an axis defined by the fluid jet is between 30 degrees and 150 degrees.

10. A fluid jet cutting system comprising:

a nozzle body;

an orifice mount received within the nozzle body, the orifice mount including an orifice unit having an orifice for generating a fluid jet during operation, the orifice having a circular cross-sectional profile with a diameter that is less than or equal to 0.010 inches;

a fluid delivery body having a fluid delivery conduit to supply a flow of high pressure fluid to the orifice of the orifice mount to generate the fluid jet during operation;

a mixing chamber insert including a mixing chamber provided downstream of the orifice mount in a path of the fluid jet, the mixing chamber being configured to receive abrasives to be mixed with the fluid jet generated by the orifice of the orifice mount to form an abrasive fluid jet;

a nozzle having a jet passageway from which to discharge the abrasive fluid jet from the fluid jet cutting head during operation, the jet passageway having a circular cross-sectional profile with a diameter that is less than or equal to 0.015 inches;

an abrasives feed line coupling a source of abrasive material to the nozzle body and having an abrasives entry passageway for supplying abrasives to the mixing chamber insert; and an abrasives suction line coupling a vacuum source to the nozzle body and having an abrasives exit passageway for assisting in drawing abrasives into the mixing chamber insert and withdrawing abrasives that are not mixed with the fluid jet out of the mixing chamber insert during operation, the abrasive suction line positioned upstream of the abrasives feed line with respect to the path of the fluid jet, and wherein a cross-sectional area of the abrasives entry passageway of the abrasives feed line is smaller than a cross-sectional area of the abrasives exit passageway of the abrasives suction line.

11. A fluid jet cutting head comprising:

a nozzle body;

an orifice mount received within the nozzle body, the orifice mount including an orifice unit having an orifice for generating a fluid jet during operation, the orifice having a circular cross-sectional profile with a diameter that is less than or equal to 0.010 inches;

a fluid delivery body having a fluid delivery conduit to supply a flow of high pressure fluid to the orifice of the orifice mount to generate the fluid jet during operation;

a mixing chamber provided downstream of the orifice mount in a path of the fluid jet, the mixing chamber being configured to receive abrasives to be mixed with the fluid jet generated by the orifice of the orifice mount to form an abrasive fluid jet;

a nozzle having a jet passageway from which to discharge the abrasive fluid jet from the fluid jet cutting head during operation, the jet passageway having a circular cross-sectional profile with a diameter that is less than or equal to 0.015 inches; and a mixing chamber insert, the mixing chamber insert including the mixing chamber through which the fluid jet passes during operation, an abrasives inlet conduit through which abrasives flow to the mixing chamber during operation, and an abrasives outlet conduit through which abrasives flow from the mixing chamber during operation, wherein the abrasives outlet conduit diverges from the path of the fluid jet, a location of an intersection of the abrasives inlet conduit with the mixing chamber being vertically offset from a location of an intersection of the abrasives outlet conduit with the mixing chamber, and the abrasives outlet conduit is angularly offset from the orifice, the jet passageway, or both the orifice and the jet passageway.

12. The fluid jet cutting head of claim 11, further comprising:

a plurality of adjustment pins, each actuable to move the orifice mount relative to the nozzle and along a respective direction within a plane transverse to an axis defined by the orifice, wherein the respective direction of each of the plurality of adjustment pins is angularly offset from the respective direction of the others of the plurality of adjustment pins.

13. The fluid jet cutting head of claim 12, further comprising:

a plurality of set screws, wherein each of the plurality of set screws is paired with one of the plurality of adjustment pins to cooperatively form a respective one of a plurality of orifice mount adjusters that is actuable to align the fluid jet generated at the orifice with the jet passageway of the nozzle.

14. The fluid jet cutting head of claim 11 wherein the nozzle body comprises:

an abrasives entry passageway extending from an exterior of the nozzle body to the mixing chamber such that the abrasives entry passageway is fluidly coupled to the abrasives inlet conduit for supplying abrasives to be mixed with the fluid jet generated at the orifice during operation, the abrasives entry passageway defining an abrasives entry direction toward the abrasives inlet conduit; and an abrasives exit passageway extending from the exterior of the nozzle body to the mixing chamber such that the abrasives exit passageway is fluidly coupled to the abrasives outlet conduit for withdrawing abrasives that are not mixed with the fluid jet, the abrasives exit passageway defining an abrasives exit direction away from the abrasives outlet conduit, and wherein a spread angle defined by the abrasives entry direction and the abrasives exit direction projected onto a reference plane that is perpendicular to an axis defined by the fluid jet is between 30 degrees and 150 degrees.

15. A fluid jet cutting system including the fluid jet cutting head of claim 11 and further comprising:

an abrasives feed line coupling a source of abrasive material to the nozzle body and having an abrasives entry passageway fluidly coupled to the abrasives inlet conduit for supplying abrasives to the mixing chamber insert; and an abrasives suction line coupling a vacuum source to the nozzle body and having an abrasives exit passageway fluidly coupled to the abrasives outlet conduit for assisting in drawing abrasives into the mixing chamber insert and withdrawing abrasives that are not mixed with the fluid jet out of the mixing chamber insert during operation, wherein a cross-sectional area of the abrasives entry passageway of the abrasives feed line is smaller than a cross-sectional area of the abrasives exit passageway of the abrasives suction line.

16. A fluid jet cutting head comprising:

a nozzle body;

an orifice mount received within the nozzle body, the orifice mount including an orifice unit having an orifice for generating a fluid jet during operation, the orifice having a circular cross-sectional profile with a diameter that is less than or equal to 0.010 inches;

a fluid delivery body having a fluid delivery conduit to supply a flow of high pressure fluid to the orifice of the orifice mount to generate the fluid jet during operation;

a mixing chamber provided downstream of the orifice mount in a path of the fluid jet, the mixing chamber being configured to receive abrasives to be mixed with the fluid jet generated by the orifice of the orifice mount to form an abrasive fluid jet;

a nozzle having a jet passageway from which to discharge the abrasive fluid jet from the fluid jet cutting head during operation, the jet passageway having a circular cross-sectional profile with a diameter that is less than or equal to 0.015 inches; and a mixing chamber insert, the mixing chamber insert including the mixing chamber through which the fluid jet passes during operation, an abrasives inlet conduit through which abrasives flow to the mixing chamber during operation, and an abrasives outlet conduit through which abrasives flow from the mixing chamber during operation, a location of an intersection of the abrasives inlet conduit with the mixing chamber being vertically offset from a location of an intersection of the abrasives outlet conduit with the mixing chamber such that the location of the intersection of the abrasives outlet conduit with the mixing chamber is closer to the orifice mount than the location of the intersection of the abrasives inlet conduit with the mixing chamber is from the orifice mount.

17. The fluid jet cutting head of claim 16, further comprising:

a plurality of adjustment pins, each actuable to move the orifice mount relative to the nozzle and along a respective direction within a plane transverse to an axis defined by the orifice, wherein the respective direction of each of the plurality of adjustment pins is angularly offset from the respective direction of the others of the plurality of adjustment pins.

18. The fluid jet cutting head of claim 17, further comprising:

a plurality of set screws, wherein each of the plurality of set screws is paired with one of the plurality of adjustment pins to cooperatively form a respective one of a plurality of orifice mount adjusters that is actuable to align the fluid jet generated at the orifice with the jet passageway of the nozzle.

19. The fluid jet cutting head of claim 16 wherein the nozzle body comprises:

an abrasives entry passageway extending from an exterior of the nozzle body to the mixing chamber such that the abrasives entry passageway is fluidly coupled to the abrasives inlet conduit for supplying abrasives to be mixed with the fluid jet generated at the orifice during operation, the abrasives entry passageway defining an abrasives entry direction toward the abrasives inlet conduit; and an abrasives exit passageway extending from the exterior of the nozzle body to the mixing chamber such that the abrasives exit passageway is fluidly coupled to the abrasives outlet conduit for withdrawing abrasives that are not mixed with the fluid jet, the abrasives exit passageway defining an abrasives exit direction away from the abrasives outlet conduit, and wherein a spread angle defined by the abrasives entry direction and the abrasives exit direction projected onto a reference plane that is perpendicular to an axis defined by the fluid jet is between 30 degrees and 150 degrees.

20. A fluid jet cutting system including the fluid jet cutting head of claim 16 and further comprising:

an abrasives feed line coupling a source of abrasive material to the nozzle body and having an abrasives entry passageway fluidly coupled to the abrasives inlet conduit for supplying abrasives to the mixing chamber insert; and an abrasives suction line coupling a vacuum source to the nozzle body and having an abrasives exit passageway fluidly coupled to the abrasives outlet conduit for assisting in drawing abrasives into the mixing chamber insert and withdrawing abrasives that are not mixed with the fluid jet out of the mixing chamber insert during operation, wherein a cross-sectional area of the abrasives entry passageway of the abrasives feed line is smaller than a cross-sectional area of the abrasives exit passageway of the abrasives suction line.

21. A fluid jet cutting system comprising:

a nozzle body;

an orifice mount received within the nozzle body, the orifice mount including an orifice unit having an orifice for generating a fluid jet during operation, the orifice having a circular cross-sectional profile with a diameter that is less than or equal to 0.010 inches;

a fluid delivery body having a fluid delivery conduit to supply a flow of high pressure fluid to the orifice of the orifice mount to generate the fluid jet during operation;

a mixing chamber insert including a mixing chamber provided downstream of the orifice mount in a path of the fluid jet, the mixing chamber being configured to receive abrasives to be mixed with the fluid jet generated by the orifice of the orifice mount to form an abrasive fluid jet, the mixing chamber insert further including an abrasives inlet conduit through which abrasives flow to the mixing chamber during operation, and an abrasives outlet conduit through which abrasives flow from the mixing chamber during operation, a location of an intersection of the abrasives inlet conduit with the mixing chamber being provided downstream from a location of an intersection of the abrasives outlet conduit with the mixing chamber with respect to the path of the fluid jet;

a nozzle having a jet passageway from which to discharge the abrasive fluid jet from the fluid jet cutting head during operation, the jet passageway having a circular cross-sectional profile with a diameter that is less than or equal to 0.015 inches; and a plurality of adjustment pins, each actuable to move the orifice mount relative to the nozzle and along a respective direction within a plane transverse to an axis defined by the orifice, wherein the respective direction of each of the plurality of adjustment pins is angularly offset from the respective direction of the others of the plurality of adjustment pins;

an abrasives feed line coupling a source of abrasive material to the nozzle body, the abrasives feed line having an abrasives entry passageway fluidly coupled to the abrasives inlet conduit for supplying abrasives to the mixing chamber insert; and an abrasives suction line coupling a vacuum source to the nozzle body, the abrasives suction line having an abrasives exit passageway fluidly coupled to the abrasives outlet conduit for assisting in drawing abrasives into the mixing chamber insert via the abrasives feed line and withdrawing abrasives that are not mixed with the fluid jet out of the mixing chamber insert during operation, and wherein a cross-sectional area of the abrasives entry passageway of the abrasives feed line is smaller than a cross-sectional area of the abrasives exit passageway of the abrasives suction line.

* * * * *